US010954702B2

(12) United States Patent
Couto Maquieira et al.

(10) Patent No.: US 10,954,702 B2
(45) Date of Patent: Mar. 23, 2021

(54) LEVELED OPENING CONTROL

(71) Applicant: AKWEL SA, Champfromier (FR)

(72) Inventors: Delmiro Javier Couto Maquieira, Pontevedra (ES); Alberto Diez Estevez, Mos Pontevedra (ES); Julio Garcia Rodriguez, Pontevedra (ES)

(73) Assignee: AKWEL SA, Champfromier (FR)

( * ) Notice: Subject to any disclaimer, the term of this patent is extended or adjusted under 35 U.S.C. 154(b) by 695 days.

(21) Appl. No.: 15/848,431

(22) Filed: Dec. 20, 2017

(65) Prior Publication Data

US 2018/0171686 A1 Jun. 21, 2018

(30) Foreign Application Priority Data

Dec. 20, 2016 (FR) ..... 16/70770

(51) Int. Cl.
*E05B 85/10* (2014.01)
*E05B 77/54* (2014.01)
(Continued)

(52) U.S. Cl.
CPC ..... *E05B 85/107* (2013.01); *E05B 77/54* (2013.01); *E05B 81/16* (2013.01); *E05B 81/90* (2013.01);
(Continued)

(58) Field of Classification Search
CPC ..... E05B 81/76; E05B 81/77; E05B 81/78; E05B 85/10; E05B 85/103; E05B 85/107;
(Continued)

(56) References Cited

U.S. PATENT DOCUMENTS 10,563,437 B2 * 2/2020 Bartels ..... B60Q 1/2669
10,760,307 B2 * 9/2020 Rocci ..... E05B 85/103
(Continued)

FOREIGN PATENT DOCUMENTS

DE 19546559 C1 6/1997
EP 2730730 A2 5/2014
(Continued)

OTHER PUBLICATIONS

Sep. 20, 2017 Search Report issued in French Patent Application No. 1670770.

*Primary Examiner* — Christine M Mills
(74) *Attorney, Agent, or Firm* — Oliff PLC

(57) ABSTRACT

The opening control includes a handle, movable in rotation relative to the casing at least between leveling, ejection and opening positions, an ejection lever connected to the handle by at least one common axis of rotation with this handle and an electric actuator for controlling a pivoting of the ejection lever between at least one ejection position and a non-ejection position. In particular, the opening control includes a biasing member connected to the ejection lever and configured to exert a force for returning the lever towards the ejection position according to an ejection direction of rotation, and means for blocking the lever in its non-ejection position. The blocking means are capable of cooperating with the lever in order to release the lever when the handle is displaced in a direction of rotation opposite to the ejection direction, by application of an external push force on the handle.

23 Claims, 16 Drawing Sheets

(51) Int. Cl.

| | |
|---|---|
| ***E05B 81/90*** | (2014.01) |
| ***E05B 81/16*** | (2014.01) |
| *E05B 77/04* | (2014.01) |
| *E05B 81/42* | (2014.01) |
| *E05B 77/42* | (2014.01) |
| *E05B 81/76* | (2014.01) |
| *E05B 81/64* | (2014.01) |
| *E05B 77/06* | (2014.01) |
| *E05B 77/38* | (2014.01) |
| *E05B 17/18* | (2006.01) |
| *E05B 81/06* | (2014.01) |

(52) U.S. Cl.
CPC ..... *E05B 85/103* (2013.01); *E05B 17/18* (2013.01); *E05B 77/04* (2013.01); *E05B 77/06* (2013.01); *E05B 77/38* (2013.01); *E05B 77/42* (2013.01); *E05B 81/06* (2013.01); *E05B 81/42* (2013.01); *E05B 81/64* (2013.01); *E05B 81/76* (2013.01)

(58) Field of Classification Search
CPC ..... E05B 77/04; E05B 77/54; E05B 81/16; E05B 81/90; E05B 77/06; E05B 77/38; E05B 77/42; E05B 81/06; E05B 81/42; E05B 81/64; E05B 17/18; Y10S 292/31; Y10T 292/57
See application file for complete search history.

(56) References Cited

U.S. PATENT DOCUMENTS

| | | | | |
|---|---|---|---|---|
| 2014/0000167 | A1 | 1/2014 | Patel et al. | |
| 2016/0222705 | A1 | 8/2016 | Velicanin | |
| 2016/0281397 | A1 | 9/2016 | Park et al. | |
| 2017/0130493 | A1* | 5/2017 | Guerin | E05B 85/107 |

FOREIGN PATENT DOCUMENTS

| | | | |
|---|---|---|---|
| EP | 3 067 494 | A1 | 9/2016 |
| FR | 3023865 | A1 | 1/2016 |
| FR | 3024173 | A1 | 1/2016 |
| GB | 2492231 | A | 12/2012 |
| WO | 2006/010649 | A1 | 2/2006 |
| WO | 2015/043705 | A1 | 4/2015 |

* cited by examiner

LEVELED OPENING CONTROL

FIELD OF THE INVENTION

The present invention concerns an opening control mechanism of a motor vehicle. In addition, the invention concerns a door leaf of a motor vehicle, for example a door, comprising such an opening control.

BACKGROUND OF THE INVENTION

In the related art, there are known few opening control devices with ejection and retraction of the handle between a leveling position with the external surface of the body of the car and an ejecting position. These opening controls are called «flush or leveled» opening controls.

The document FR 3023865 filed by the applicant describes a handle mechanism which levels with the body of a door provided with an electric actuator which actuates the ejection and the retraction of the handle. The actuator can be remote-controlled by the key of the user or by a calculator of the vehicle. This system is very ergonomic but does not operate in the event of an electrical failure.

The document FR 3024173 also filed by the applicant describes a handle mechanism, which levels with the body of a door. The handle is ejected from the door by action when the user presses on the handle. The return to the leveling position with the body is also done mechanically by the action of this user when the latter pulls the handle. This system does not depend on an electrical actuation but is less ergonomic than the previous one.

The document GB 2492231 filed by Jaguar Cars Limited describes an opening control device with an electric actuator. During an electrical failure, the user can tilt the handle in order to open the door. However, the device does not provide any member for blocking the handle of the vehicle in the parking position, or, in the event of an accident, in order to avoid an unintentional triggering of the latch by the handle. In addition, the mechanical actuation of the device is not ergonomic, the preferred operation being the electrical mode.

The document EP 2 730 730 A2 filed by Aisin Seiki Kabushiki Kaisha describes a leveled opening control, whose handle operates in a motorized manner with a rotary displacement of the handle, and having a means for blocking the handle in the protruding position. However, in the same manner as the previous device, the device does not provide any member for blocking the handle of the vehicle in the parking position, or, in the event of an accident, in order to avoid an unintentional triggering of the latch by the handle. In addition, the mechanical actuation of the device is not ergonomic, the preferred operation being the electrical mode.

The document US 2016/281397 describes a retractable handle system and a mechanism intended to control a displacement of the handle from a leveling position to an ejection position. The displacement of the handle is achieved by means of an electric drive.

The document US 2016/0222705 A1 describes a handle assembly configured to be leveled when in the closing position and to protrude when in the operating position. The assembly comprises electrically controlled arms for displacing the handle between the two positions.

SUMMARY OF THE INVENTION

The present invention aims at solving all or part of the aforementioned problems.

For this purpose, the object of the invention is a leveled door opening control, which may be ejected or retracted electrically or by a manual action, indifferently. The ejection or retraction according to the invention, whether manual or electrical, is always done in an ergonomic manner for the user. The piloting of the electrical actuation may be achieved by a remote control (key of the vehicle, mobile phone . . . ).

The invention further enables the opening of the door in the event of an electrical failure in the car, and has a means for blocking the handle in position thereby avoiding the ejection of the handle in the event of an impact or a brutal closure of the door. In the blocked handle position, when the vehicle is at stop in a parking, a malicious person cannot make the handle come out.

Another object of the invention is a function, which blocks the ejection of the handle when the car is running at a speed higher than a predetermined value, for example seven kilometers per hour.

To this end, an object of the invention is an opening control for a door leaf of a motor vehicle, such as a door, of the type comprising a casing intended to be fastened to the door leaf and a handle configured for gripping by a user, movable in rotation relative to the casing at least between:

- a leveling position in which the handle is entirely or partially housed within the case,
- an ejection position in which the handle is at least partially protruding from the case, so that the user can grab the handle and open the door leaf,
- an opening position, in which the handle has caused the unlocking of the door leaf, and further comprising a lever for ejecting the handle connected to the handle by at least one common axis of rotation, means for pivoting the lever about this axis and an electric actuator connected to the pivot means so as to electrically displace the lever at least between a blocking position and ejection position of the handle in an electrical operating mode, characterized in that it comprises a biasing member connected to the lever and configured for automatically biasing the lever from its blocking position towards its ejection position according to an ejection direction of rotation and means for blocking the lever in its blocking position and in that the lever and the pivot means are capable of mechanically cooperating so as to disengage the lever from the blocking means and cause the automatic return of the lever back into its ejection position, both in a manual operating mode by pushing the handle from its leveling position so as to drive the lever in rotation in a direction opposite to the ejection direction of rotation and in the electrical mode by electrical rotation of the pivot means by the electric actuator.

Thanks to the invention, the ejection of the handle may be achieved manually by direct action on the handle or electrically in a remote manner, for example by means of a remote control. This is done thanks to pivot means, which can be controlled electrically to unblock the ejection lever and cause the ejection of the handle or by a direct mechanical action on the handle, which will result in displacing the lever in rotation in order to disengage it from the blocking means. Then, the lever is automatically returned back into the ejection position of the handle.

In a preferred embodiment, the lever and the pivot means are capable of mechanically cooperating to displace the lever in the ejection direction or in the direction opposite to the ejection by electrical actuation of the pivot means by the electric actuator from any position of the lever.

In a preferred embodiment, the lever comprises a member for driving the blocking means arranged to cooperate with the pivot means by a releasable mechanical connect and to drive the blocking means into a disengagement position of the lever.

In a preferred embodiment, the drive member comprises a toggle rotatably attached to a head connected to the ejection lever and arranged to drive the blocking means by a tipping over likely to be caused by the mechanical cooperation with the pivot means.

In a preferred embodiment, the pivot means comprise an ejection cam movable in rotation relative to the casing about a cam axis which has a guide surface configured to cooperate releasably with the lever by guiding the drive member against the ejection cam.

In a preferred embodiment, the ejection lever and the handle are connected by a handle return spring capable of exerting a force for returning the handle towards the ejection lever.

In a preferred embodiment, the blocking means of the lever comprise an ejection lever pawl subjected to an elastic return, which urges it into an engagement position of the lever.

In a preferred embodiment, the opening control comprises a lever for retaining the lever pawl configured to retain the lever pawl in the releasing position of the lever against the return force of the lever pawl.

In a preferred embodiment, the opening control comprises a pawl for blocking the handle subjected to an elastic return, which urges it into an engagement position of the handle.

In a preferred embodiment, the pawls are arranged on a common axis so that the lever pawl is capable of blocking the lever while the blocking pawl is not in engagement with the handle.

In a preferred embodiment, the lever and the pivot means are capable of adopting a configuration corresponding to the blocked-leveled handle, a configuration corresponding to the unblocked-leveled handle and an ejected configuration corresponding to the ejected handle, the switch from one configuration to another being achievable by electrical and/or mechanical actuation.

In a preferred embodiment, the opening control comprises means for detecting information relating to a configuration of the pivot means of the lever and means for transmitting the information to the electric actuator.

In a preferred embodiment, the lever and the pivot means comprise declutching mechanical coupling means operating so that in the blocked-leveled handle configuration, the mechanical coupling is declutched and in the unblocked-leveled handle configuration, the mechanical coupling is clutched.

In a preferred embodiment, the coupling means comprising the drive member of the lever and the ejection cam, in the blocked-leveled handle configuration, and the member and the cam are sufficiently spaced apart from each other to prevent the disengagement of the lever by pushing the handle and in the unblocked-leveled configuration, the member and the cam are sufficiently close to each other to enable the disengagement of the lever by pushing the handle.

In a preferred embodiment, the opening control comprises receiving means for receiving a representative data of the speed of the motor vehicle so that when the data is higher than a predetermined value, the opening control is in the blocked-leveled handle configuration.

In a preferred embodiment, the pivot means comprise a retraction cam, movable about a cam axis, in which the retraction cam has a guide surface configured to make the lever pivot from the ejection position to the blocking position in the electrical operating mode.

In a preferred embodiment, the guide surface of the retraction cam is configured to forcibly guide, against an impediment to the automatic return of the lever back into the ejection position, the ejection of the handle by electrical actuation of the retraction cam in the reverse direction of the retraction direction.

In a preferred embodiment, the lever comprises an internal profile and a cam configured to cooperate with the retraction cam.

In a preferred embodiment, the pivot means comprise a clutch cam, movable about a cam axis and connected to the actuator, in which the clutch cam has a guide surface shaped so as to cooperate with an internal profile of the lever in order to position it in the unblocked-leveled configuration starting from the blocked-leveled configuration.

In a preferred embodiment, the internal profile of the lever is shaped so that the clutch cam cooperates with this internal profile in order to control the return movement of the lever from the blocking position back into the ejection position.

In a preferred embodiment, the lever comprises two lateral cheeks connected to each other by upper and lower transverse branches intended to bear respectively on upper and lower surfaces of an internal portion of the handle, the cheeks comprising openings for the passage of the pivot means.

In a preferred embodiment, the opening control comprises mechanical means, such as a tool or a key, allowing unlocking the opening control, when it is latched and in the absence of electrical energy, by one or several mechanical actuation(s) from the outside on the pivot means or on the blocking means.

Another object of the invention is a door leaf for a motor vehicle, including an opening control according to the invention.

BRIEF DESCRIPTION OF THE DRAWINGS

Other features and advantages of the invention will appear in the light of the following description, made with reference to the appended drawings in which.

DETAILED DESCRIPTION

Figure 1:
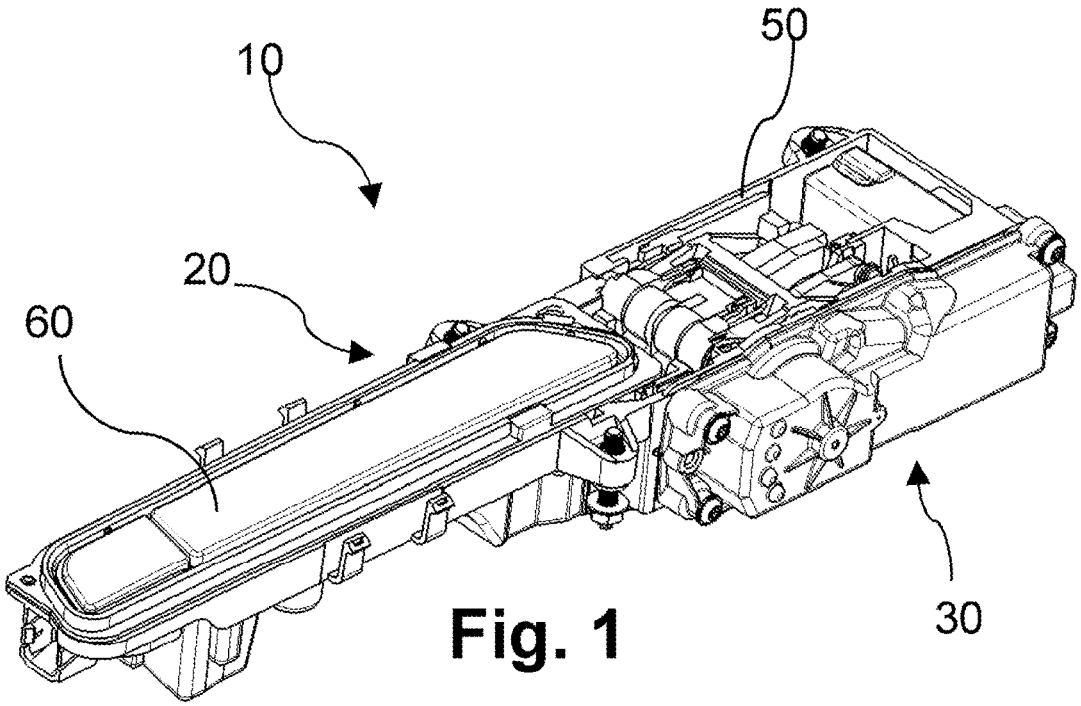
FIG. 1 is a perspective view of an opening control according to the invention comprising a mechanical portion and an electrical portion.

There is schematically shown in FIG. 1 a perspective view of an opening control according to the invention referred to by the general reference 10.

Figure 2:
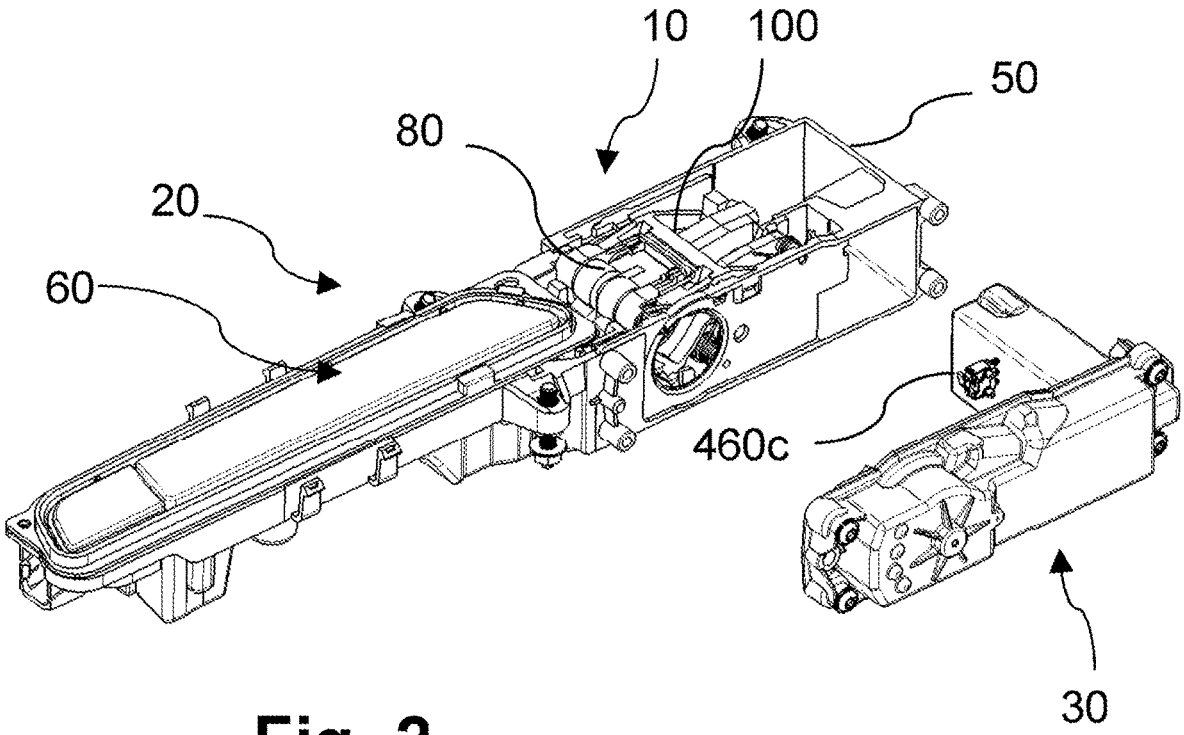
FIG. 2 is a perspective view of the opening control of FIG. 1 in which the mechanical portion and the electrical portion are separate from each other.

The opening control 10 comprises a mechanical portion 20 and an electrical portion 30. In FIG. 2, there is represented the opening control 10 in which the mechanical portion 20 and the electrical portion 30 are separated from each other. The opening control 10 further comprises a casing 50 intended to house the electrical 30 and mechanical 20 portions as illustrated in FIGS. 1 and 2.

Conventionally, the opening control 10 comprises a handle 60 configured for gripping by a user. This handle 60 is movable in rotation relative to the casing 50 between several positions described hereinafter with reference to FIGS. 3A to 3D. In these FIGS., there are represented the main possible positions adopted by the handle 60. In FIGS. 3A to 3D, the opening control 10 is represented assembled on a door 70 of a body of a motor vehicle. The casing 50 is intended to be fastened to the door leaf 70.

Figure 3A:
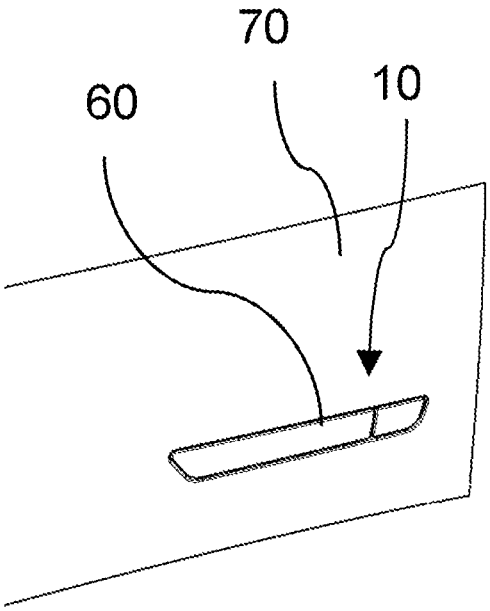
FIGS. 3*a* to 3*d* illustrate different positions of a handle of the opening control according to the invention.

FIG. 3A illustrates the opening control 10 and its handle 60 in a leveling position with respect to the body 70 in which the handle 60 is entirely or partially housed within the casing 50, that is to say that the external surface of the opening control 10 coincides with the external surface of the door leaf 70. This leveled arrangement, known in the automotive industry, allows adding value to the style of the vehicle and reduces the aerodynamic drag.

In this leveling position, the handle 60 of the opening control 10 may be:

- either «blocked», that is to say that a mechanical action on the handle 60 will not cause its ejection,
- or «unblocked», and in this latter casing a push action on the handle 60 will cause its ejection as will be described later on.

Figure 3B:
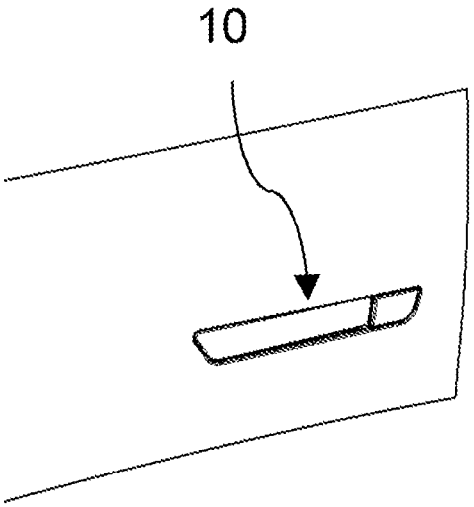

FIG. 3B illustrates the handle 60 in a position pushed inwardly of the door leaf 70. This pushing of the handle 60 may lead, in the casing where the opening control 10 is unblocked to a control of the ejection of the handle 60. Conversely, when the opening control 10 is blocked, pushing the handle 60 will not cause the ejection of the handle 60. This will be explained in detail hereinafter.

Figure 3C:
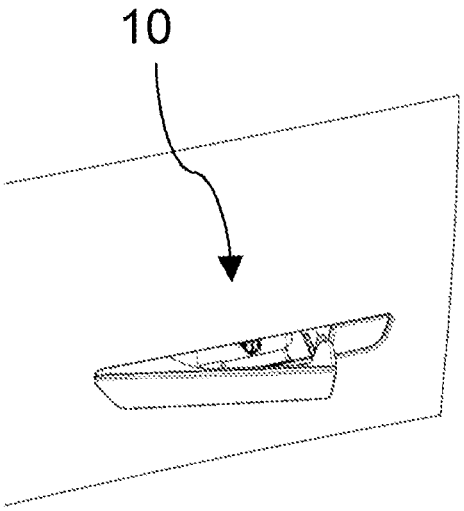

FIG. 3C illustrates the handle 60 in the «ejected» position, ready to be grabbed by the user in order to be pulled and thus trigger the opening of the latch and of the door. In the ejected position, the handle 60 is at least partially protruding from the casing 50, so that the user can grab the handle 60 and open the door leaf 70.

Figure 3D:
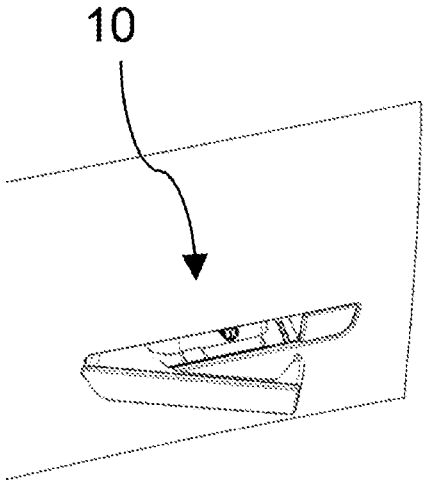

FIG. 3D illustrates the handle 60 in the «pulled» position or open position, which position corresponds to a triggering of the latch and to the opening of the door and in which the handle 60 has caused the unlocking of the door leaf 70.

Figure 4:
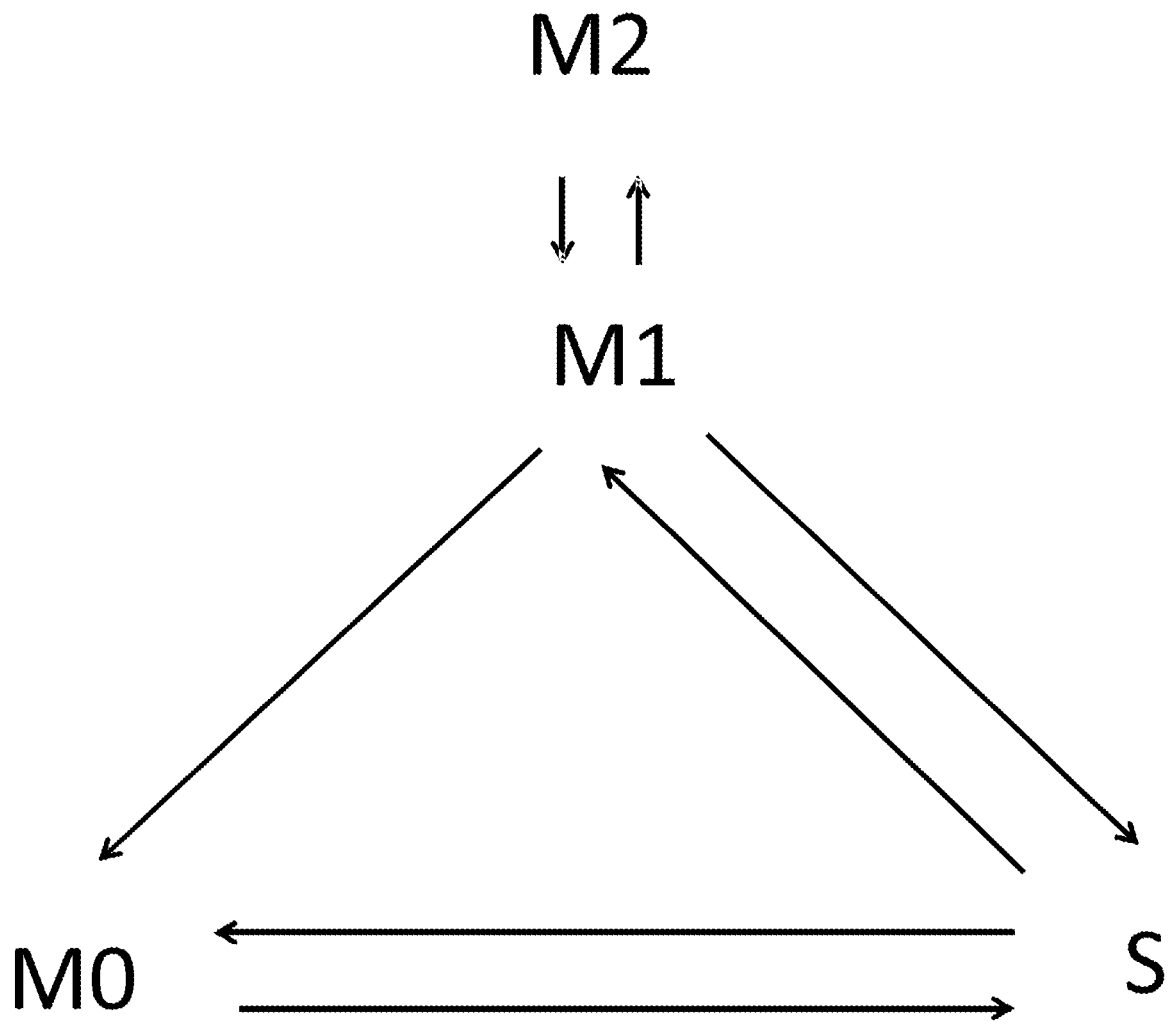
FIG. 4 schematically illustrates different operating configurations of the opening control of the invention.

Moreover, different operating configurations of the opening control 10 are schematically illustrated in FIG. 4:

- the configuration M0 corresponds to a configuration in which the handle 60 is in a leveling position in accordance with FIG. 3A and blocked;
- the configuration S corresponds to a configuration in which the handle 60 is in a leveling position in accordance with FIG. 3A and unblocked;
- the configuration M1 corresponds to a configuration in which the handle 60 is in an ejected position (FIG. 3C);
- the configuration M2 corresponds to an opening of the door.

The arrows illustrate the different actions (retraction-ejection, blocking-unblocking) to carry out in order to switch from one configuration to another, which will be detailed hereinafter.

Figure 5:
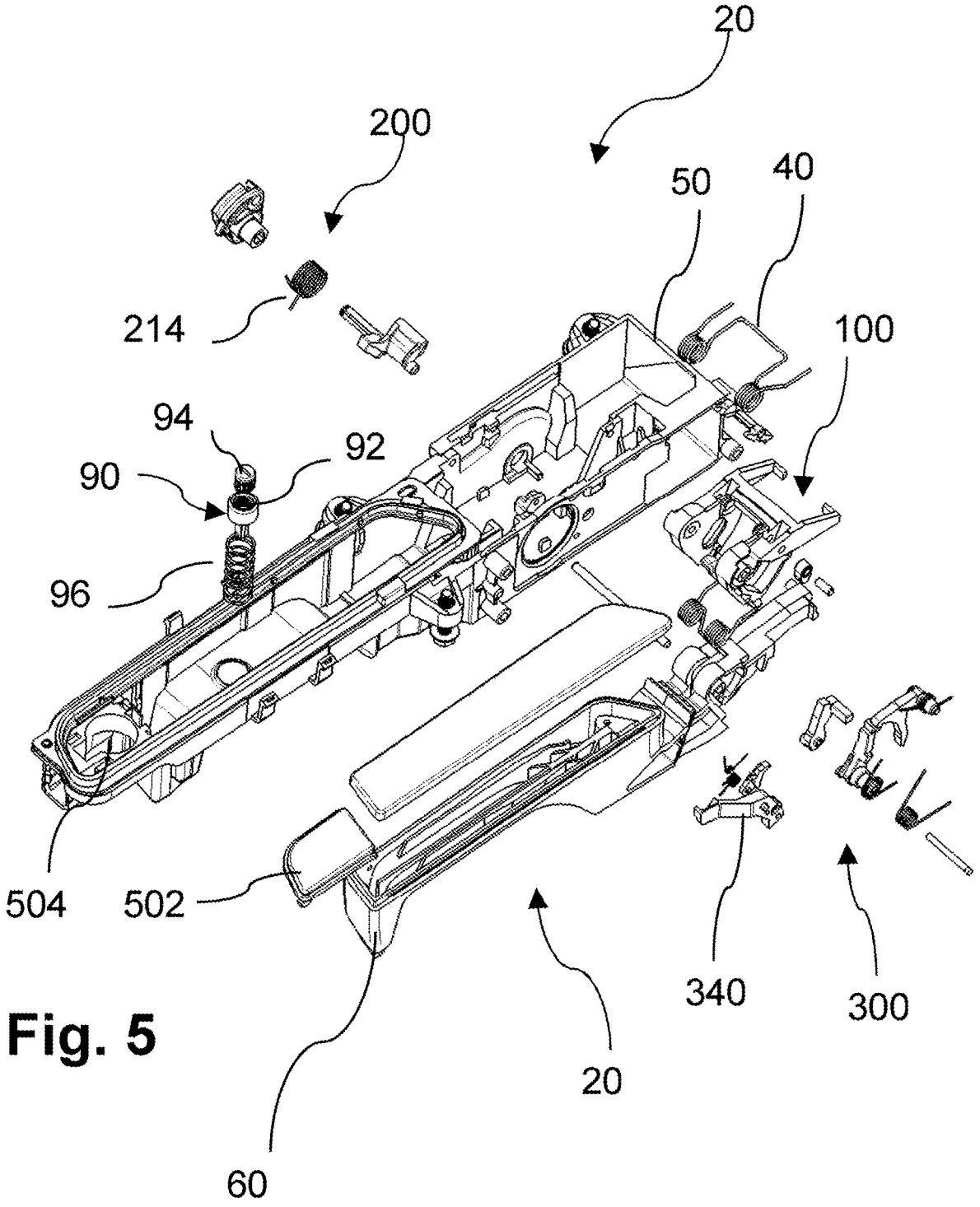
FIG. 5 shows an exploded perspective view of the mechanical portion of the opening control of FIG. 1.

The mechanical portion 20 will now be described in more detail with reference to FIGS. 5 to 14. FIG. 5 is an exploded view of the mechanical portion 20.

Figure 6:
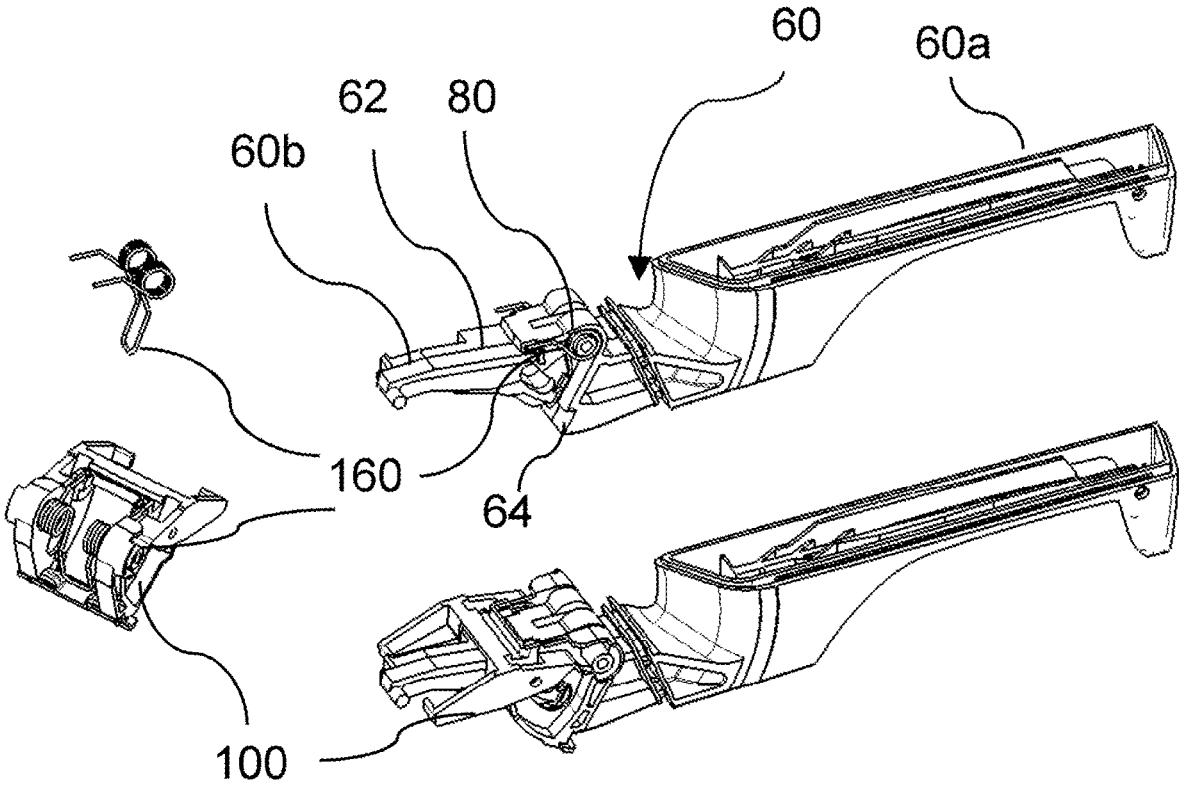
FIG. 6 illustrates a perspective view of the internal, external and ejection levers of the opening control of FIG. 1.

In FIG. 6, we see in particular that the handle 60 comprises two portions: an external lever 60*a* and an internal lever 60*b*. Referring to this FIG., we see that, conventionally, the external lever 60*a* has a length much greater than that of the internal lever 60*b*, which confers a «lever effect», known to those skilled in the art and is configured to enable gripping. As illustrated in FIG. 6, the handle 60 is rotatably mounted about a pivot axis 80 secured to the casing 50.

In accordance with the invention, the opening control 10 further comprises a lever 100 for ejecting the handle 60. As illustrated in FIG. 6, this ejection lever 100 is mounted on the pivot axis 80 of the handle 60. Thus, the lever 100 is connected to the handle 60 by at least one common axis of rotation 80.

The ejection lever 100 is an ejection mechanism and constitutes an essential part of the invention. The ejection lever 100 allows separating the handle 60 from the mechanisms, which control it, which allows selecting between a mechanical and electrical operation depending on the situation, or depending on the preference of the user, and always in an ergonomic manner for the user, except the casing of an electrical failure, which will be described later on. This possibility to indifferently use a mechanical or electrical operating mode, while preserving the easiness of controlling and using the opening con troll constitutes one of the major advantages of the invention. The mechanisms, which control the movement of the ejection lever, will be described later on.

The ejection lever 100 will now be described with reference to FIGS. 7 to 11.

Figure 7:
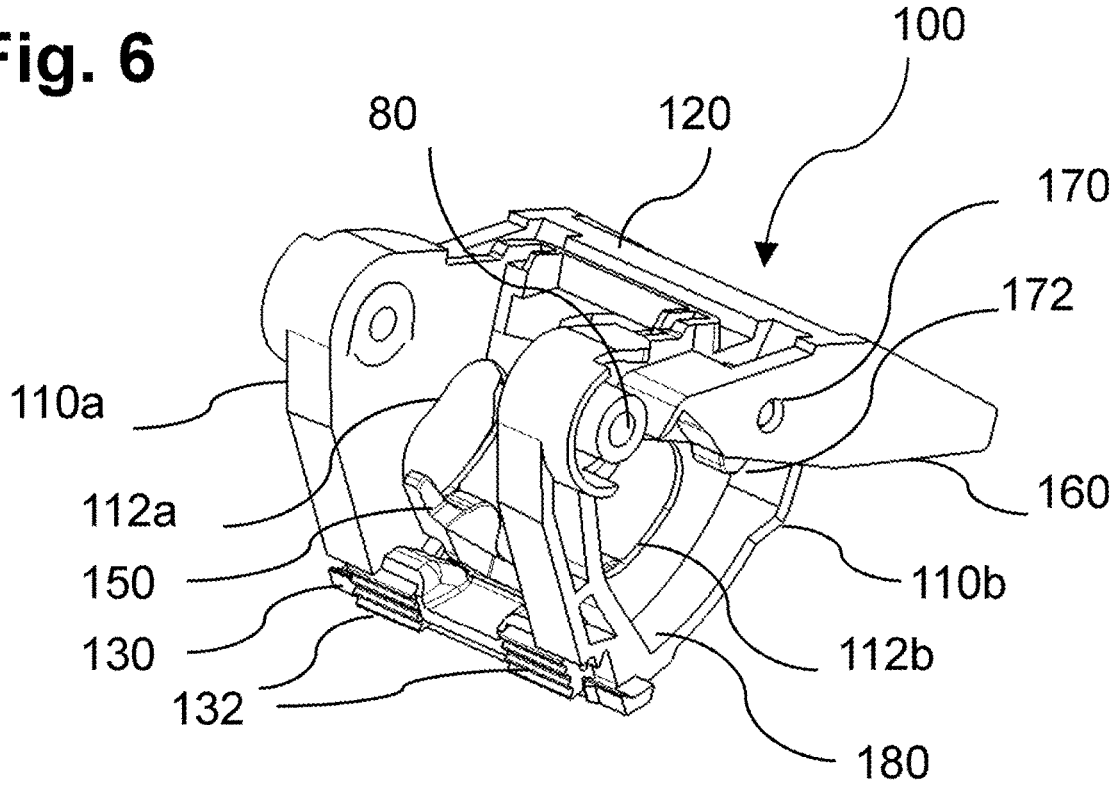
FIG. 7 is a perspective view of the ejection lever of FIG. 6.
Figure 8:
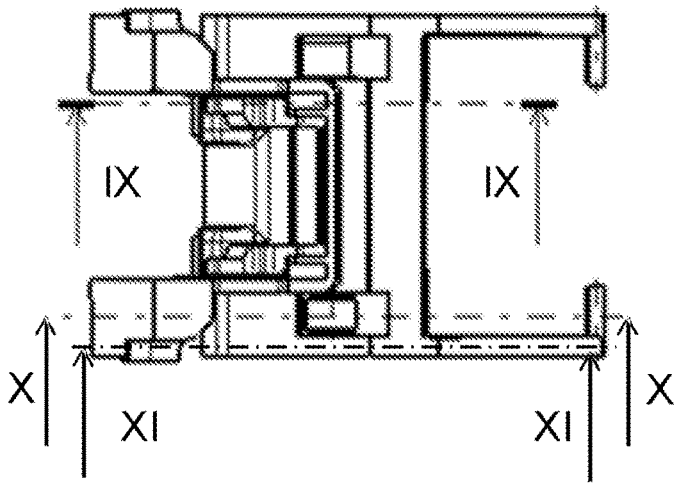
FIG. 8 is a top view of the ejection lever of FIG. 7.

In the example illustrated in FIG. 7, the ejection lever 100 has a first cheek 110*a* and a second cheek 110*b*, the two cheeks being parallel to each other and perpendicular to the axis of rotation 80. These cheeks 110 are connected at one side by an upper transverse branch 120 intended to bear against the upper surface 62 of the internal lever 60*b* and at another side by a lower transverse branch 130, which is intended to bear against a lower bearing wall 64 of the internal lever 60*b* shown in FIG. 6.

Preferably, the ejection lever 100 also has two openings 112*a* and 112*b* disposed in the cheeks 110*a* and 110*b*. These openings 112*a* and 112*b* are intended to enable the passage of a set of cams 450 of the electrical portion 30 of the opening control 10, which will be described later on as well as the cooperation of the ejection lever 100 with this set of cams 450.

This configuration of the ejection lever 100 allows implementing either a manual or an electrical ejection control, in the unblocked handle position, as well as the blocking of an ejection control, in the blocked handle position, as will be described later on. This particular configuration of the ejection lever 100 is not restrictive and those skilled in the art will be able to imagine a different mechanism achieving an equivalent function.

Preferably, the lower transverse branch 130 of the ejection lever 100 is provided with two noise-insulating stops 132 made of an elastomeric material, whose function is to dampen the noises of contact between the ejection lever 100 and the lower bearing wall 64 of the internal lever 60*b*. The dampening of the noise takes place during the return of the internal lever 60*b* towards the ejection lever 100, in particular during the return from the opening position to the ejected handle position.

FIG. 6 shows the handle 60 provided with a handle return spring 160 which is placed between the ejection lever 100 and the internal lever 60*b* of the handle 60 and which have a common axis of rotation 80.

The handle return spring 160 has two legs and a central portion. The function of the handle return spring 160 is to maintain a contact between the internal lever 60*b* and the ejection lever 100, or a return force, that is to say to compensate a clearance between these two elements 60*b* and 100.

The handle return spring 160 is used in two cases:

when the external lever 60*a* levels with the body of the car and when the user pushes on the external lever 60*a* inwardly of the door (FIG. 3B) in order to manually control its ejection outwardly of the vehicle. The handle return spring 160 is compressed during the push on the external lever 60*a* and afterwards brings the handle 60 back into contact with the ejection lever 100 after the push on the external lever 60*a*. If the opening control is unblocked at the time of the push, an ejection movement of the ejection lever 100 and of the handle 60 will follow the push applied by the user. If the opening control is blocked at the time of the push on the handle, then the handle will return into the leveled position without ejection of the latter.

when from the ejection position, after having pulled the external lever 60*a* outwardly of the door, into the opening position, the user releases the external lever 60*a*. The handle return spring 160 then creates a return torque, which tends to bring the internal lever 60*b* back against the ejection lever 100.

Furthermore, the opening control 10 further comprises a biasing member 40 connected to the lever 100. The biasing member 40 is configured to return the lever 100 into a position called ejection position of the handle 60.

This biasing member 40 comprises preferably an ejection lever spring 40 illustrated in FIG. 5, which is provided with two external legs and with a central portion. We see in FIG. 12 the ejection lever spring 40 installed in the casing 50. Each of the two legs is fastened respectively to an internal wall, of the casing 50. The central portion of the spring 40 is intended to push the ejection lever 100 towards the lower bearing wall 64 of the handle 60 in order to eject the handle 60.

According to the invention, the opening control 10 further comprises means 450 for pivoting the lever 100 about the common axis of rotation 80 and means 300 for blocking the lever 100 in a blocking position against the return force exerted by the biasing member 40.

According to the invention, the biasing member 40 is configured to automatically return the lever 100 from its blocking position towards its ejection position according to an ejection direction of rotation when the lever 100 is released from the blocking means 300.

Figure 9:
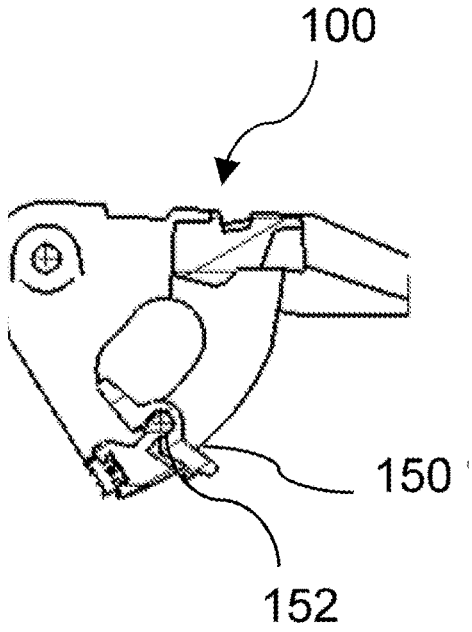
FIGS. 9 to 11 are sectional views of the ejection lever according to the respective section lines IX-IX, X-X, XI-XI of FIG. 8.

The ejection lever 100 further comprises preferably a member 150 for driving the blocking means 300 and is provided for example with a toggle 150 represented in particular in FIGS. 7 and 9. The drive member 150 is arranged to cooperate with the pivot means 450 by a releasable guide mechanical connect and to drive the blocking means 300 into a disengagement position of the lever 100. By releasable mechanical connection, is meant a link, which is not permanent so that the blocking means 300 and the lever 100 do not mechanically cooperate in a permanent manner. Preferably, the drive member 150 comprises a toggle 150 rotatably attached to a head 152 connected to the ejection lever 100.

In the illustrated example, the toggle 150 is formed by a rotary lever including a first arm and a second arm. The toggle 150 is rotatably attached to the head 152 connected to the ejection lever 100, in the proximity of the lower branch 130 and of the first cheek 110*a*. The head 152 constitutes the axis of rotation of the toggle 150. For example, the toggle 150 can turn by 15° to 45° about its axis of rotation.

Figure 11:
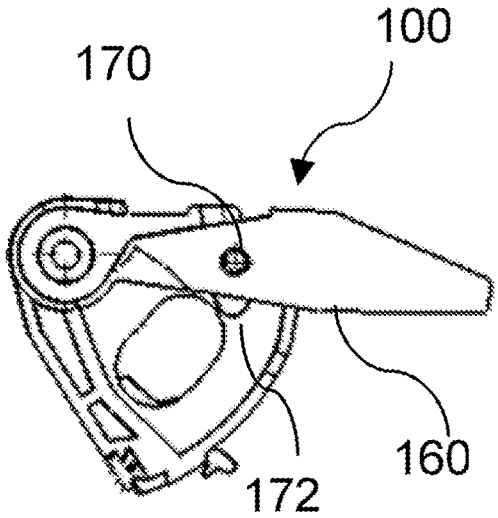
Figure 12:
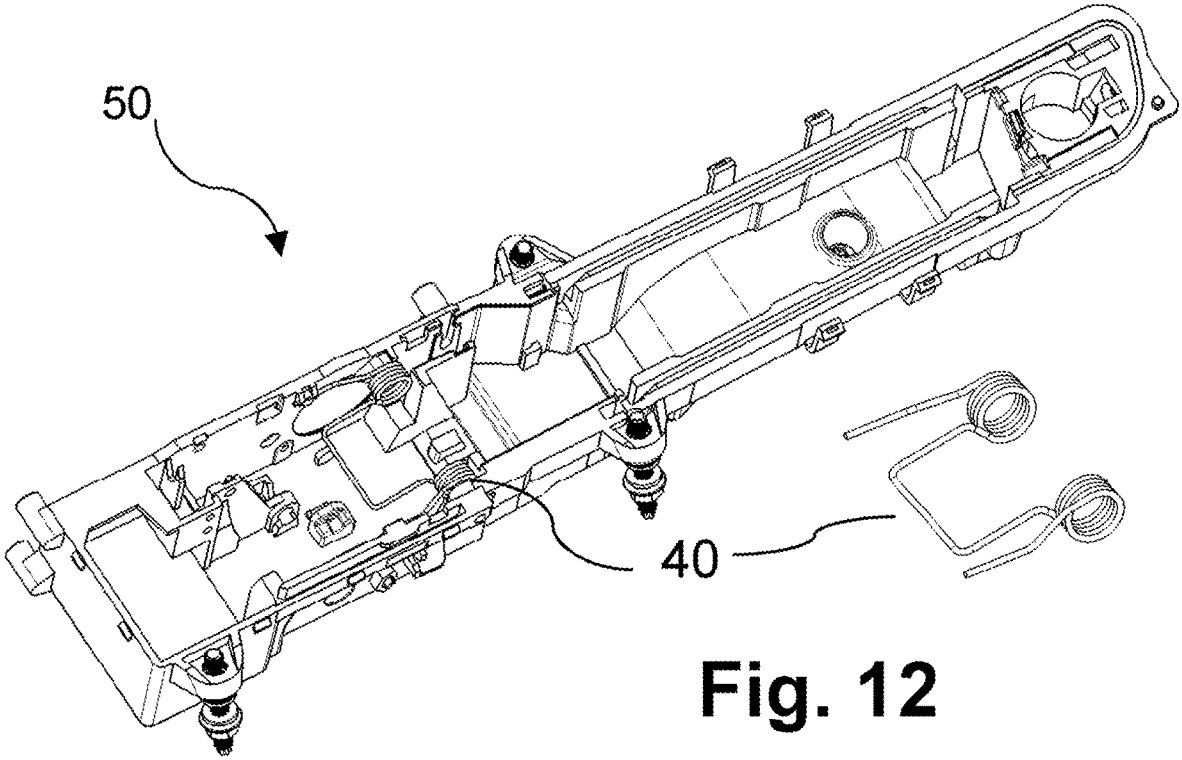
FIG. 12 is a perspective view of a casing of the opening control of FIG. 1.
Figure 13A:
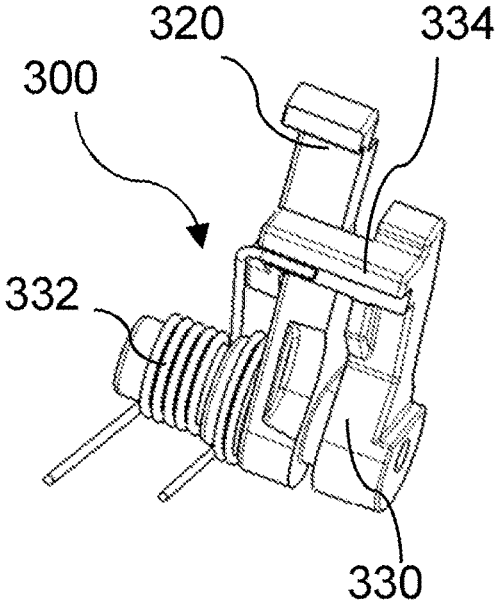
FIGS. 13A to 16B are perspective views of a pawls assembly of the opening control according to the invention.
Figure 13B:
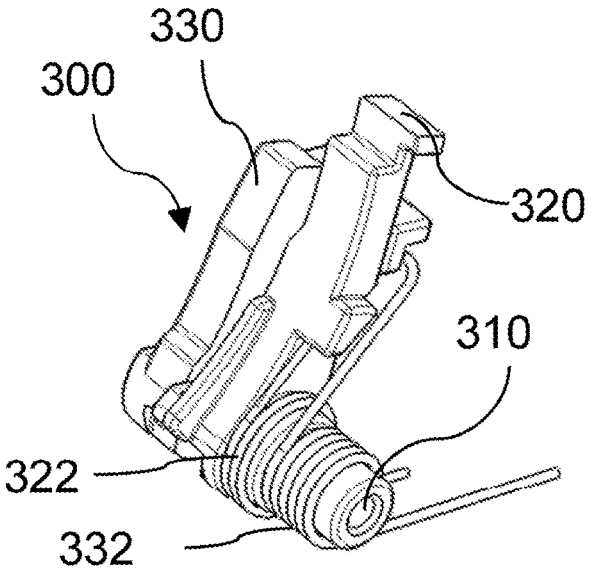

At the side of the second cheek 110*b*, the ejection lever 100 is provided with an upper profile 160 reference in FIGS. 7 and 11. The upper profile 160 is connected to the upper transverse branch 120, and is transversal to the latter.

Figure 10:
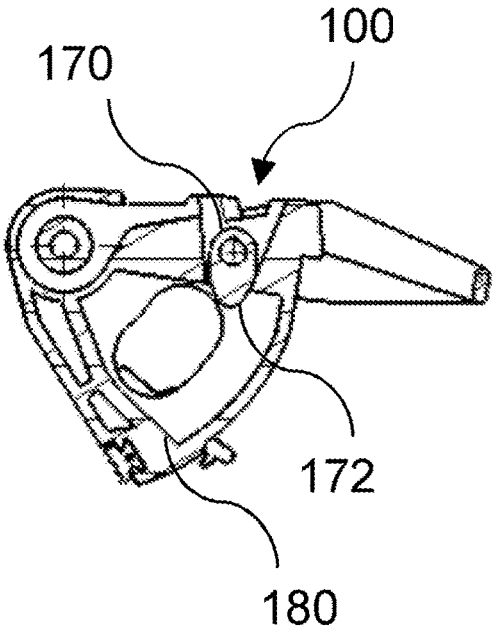

In FIG. 10, we see that the ejection lever 100 is preferably provided with a cam axis 170 transverse to the upper profile 160 and parallel to the common axis 80. An ejection lever cam 172 is rotatably connected to the cam axis 170. For example, the ejection lever cam 172 can turn by 5° to 15° about its axis of rotation 170.

The ejection lever 100 is also provided, in this example, with an internal profile 180, which is connected to the lower transverse branch 130, and is transversal to the latter, represented in detail in FIGS. 7 and 10. The lower profile 180 and the ejection lever cam 172 lie in the same plane represented in FIG. 10.

As represented in detail in FIG. 5, the blocking means 300 comprise a pawl mechanism. This pawl mechanism carries the general reference 300.

Figure 14:
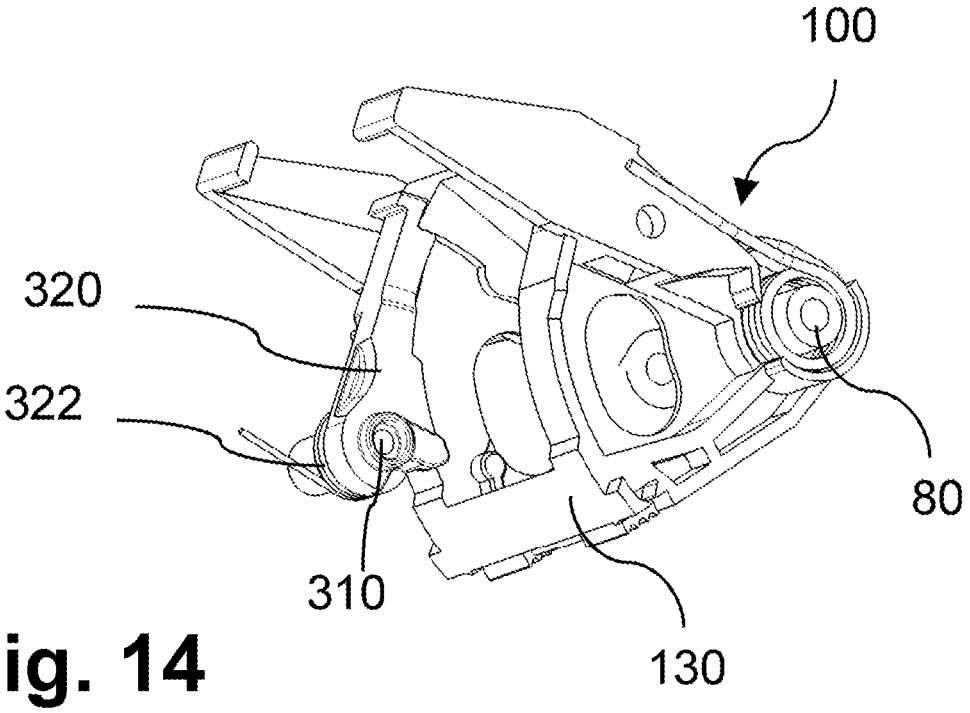

The pawl mechanism 300 is shown in detail in FIGS. 13 to 15. This mechanism 300 comprises a pawl axis 310, parallel to the axis of rotation 80 of the ejection lever 100. This mechanism 300 comprises a first pawl 320 of the ejection lever 100 subjected to an elastic return which urges it into a position of engagement with the lever 100.

The first pawl 320, called ejection lever pawl, is provided with a first torsion spring 322. The function of the ejection lever pawl 320 is to block the rotation of the ejection lever 100, and therefore block the ejection of the handle 60. Indeed, as shown in FIG. 14, the first pawl 320 is arranged to be displaced between a first position in which the first pawl 320 engages with the ejection lever 100 and blocks the ejection of the ejection lever 100 and a second position in which the first pawl 320 is no longer in engagement with the ejection lever 100.

The mechanism 300 further comprises a second pawl 330, called handle blocking pawl, which is for example provided with a second torsion spring 332. This handle-blocking pawl 330 is subjected to an elastic return, which urges it into an engagement position of the handle 60.

Figure 15A:
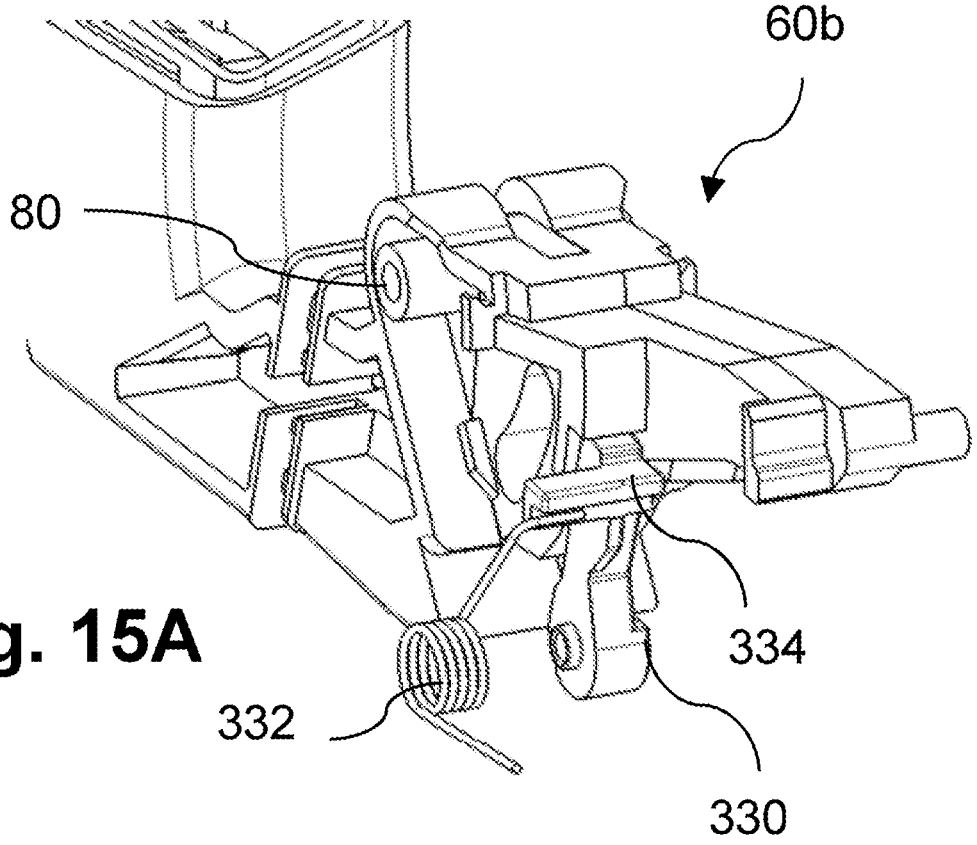
Figure 15B:
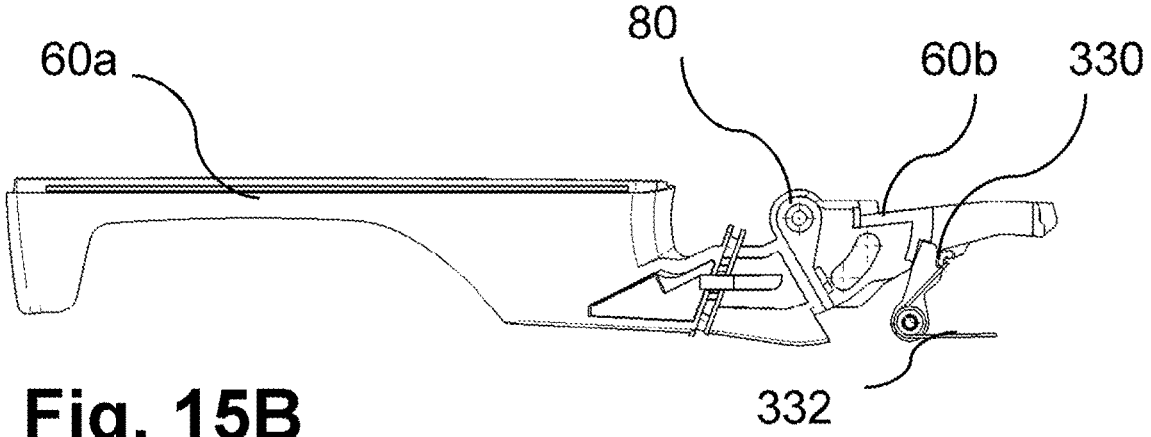

As shown in FIGS. 15A and 15B, the second pawl 330 is arranged to be displaced between a first position in which the pawl 330 engages with the internal lever 60*b* of the handle 60 and blocks the ejection of the handle 60 and a second position in which the second pawl 330 is no longer in engagement with the internal lever 60*b*.

Preferably, the pawls 320 and 330 are arranged on a common axis so that the lever pawl 320 is capable of blocking the lever while the blocking pawl 330 is not in engagement with the handle 60.

To this end, the handle blocking pawl 330 is further provided with a transverse branch 334 (FIGS. 13A and 13B), which abuts against the ejection lever pawl 320. The second torsion spring 332 is wound around the pawl axis 310 and is in contact with the branch 334, and drives the handle blocking pawl 330 towards the ejection lever pawl 320 in the counterclockwise direction defined according to FIG. 13B.

Figure 16A:
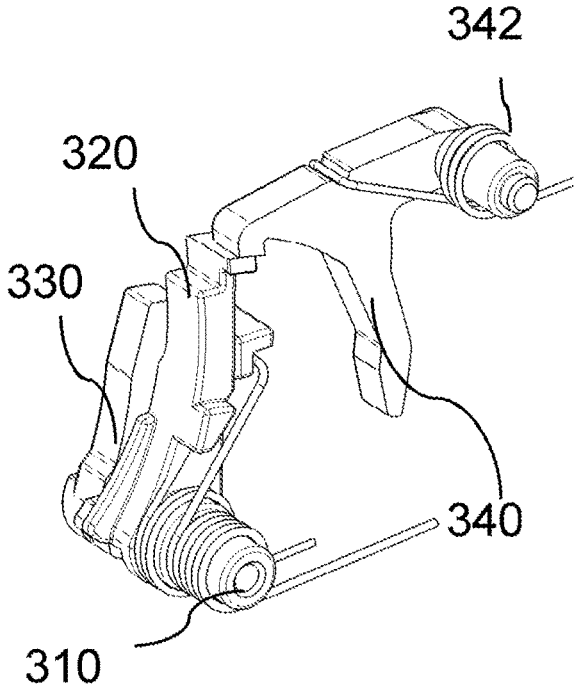
Figure 16B:
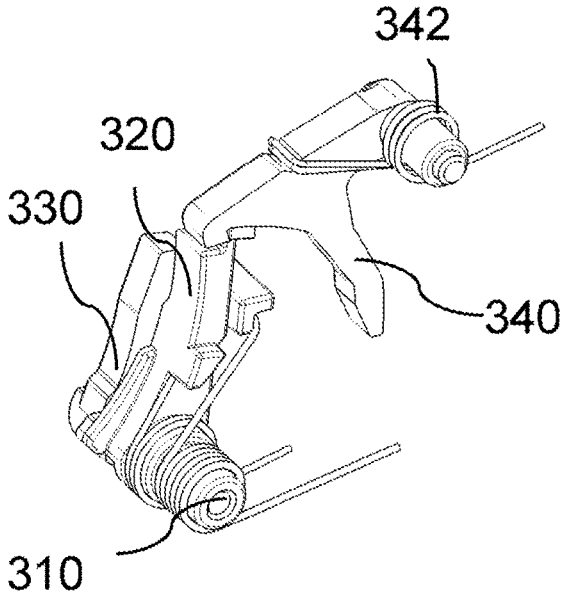

The opening control 10 further comprises preferably a pawl retaining lever 340 which is positioned facing the ejection lever pawl 320 and is provided with a return spring called retaining lever spring 342 (FIG. 16A or 16B). This lever 340 is illustrated in detail by FIGS. 16A and 16B. This retaining lever 340 is configured to retain the lever pawl 320 in the releasing position of the lever 100 against the return force of the lever pawl 320.

As shown in FIG. 16B, the pawl retaining lever 340 blocks the rotational movement of the ejection lever pawl 320 in the counterclockwise direction which, in turn, blocks the movement of the handle blocking pawl 330 and, therefore, the ejection lever 100 can turn freely in rotation without interfering with the ejection lever pawl 320. Therefore, the handle blocking pawl 330 is blocked in the counterclockwise direction defined according to FIG. 13B by the ejection lever pawl 320.

FIG. 16A shows a position in which the pawl-retaining lever 340 does not block the ejection lever pawl 320, which then blocks the ejection lever 100, as can be seen in illustration in FIG. 14. The handle blocking pawl 330, blocked by the ejection lever pawl 320 in the counterclockwise direction, will specifically block the internal lever 60*b* (see FIG. 15B) and will consequently block the rotation of the handle 60.

The reason behind the separation of the rotation blockings with two distinct elements 320 and 330 will be exposed hereinafter.

In the blocking position of the handle 60, the handle blocking pawl 330 abuts against the internal lever 60*b* and blocks the rotation of the handle 60 in the clockwise direction according to FIG. 15B, that is to say that it prevents any ejection of the handle 60 outwardly of the door.

The function of the handle-blocking pawl 330 is to prevent the ejection of the handle 60 by the inertial action of a violent impact, or of an accident, or, for example, by a rebound of the handle during a strong door slam. Thus, an unintentional triggering of the door latch because of the ejection of the handle is impossible, in particular during an accident, which considerably contributes to the safety brought by the device according to the invention.

A specific function and the purpose of the handle blocking pawl 330, which is a part separate from the ejection lever pawl 320, and which has a capability of rotation relative to the ejection lever 320, is that, if the user manually keeps the handle 60 in the ejection position while the vehicle should be locked, then this independent rotational movement of the ejection lever pawl 320 still allows the locking of the door lock. Thus, the ejection lever pawl 320 can block the rotation of the ejection lever 100, independently of the pawl 330, and the opening of the door is blocked, even though the handle 60 has remained in an ejection position, retained by the hand of the user. Thus, the user can no longer open the door by exerting a rotation of the handle, the door opening is blocked independently of the protruding position of the handle.

In FIGS. 5, 17A to 18, is further represented a transmission mechanism 200 comprising a transmission lever 210 which turns integrally with a transmission axis 212 which is returned by a transmission spring 214. A Bowden cable (not represented) is commonly used on this type of mechanisms to actuate the latch and open the door. The transmission axis 212 is provided with a cam 220.

The tip of the cable is generally attached to the transmission and the sheath of the cable is fastened to the casing 50. When the lever 60*a* and the ejection lever 100, which have a common axis 80, are in the ejection position, an interaction is possible between the internal lever 60*b* and the cam 220 on the transmission axis 212, which turns integrally with the transmission lever 210.

During the pulling of the lever 60*a* by the user up to the door opening position, the action on the cam 220 makes the transmission lever 210 turn. The rotation of the transmission lever 210 results in the pulling of the Bowden cable and therefore the opening of the latch of the door. It should be noted that pulling on the Bowden cable is possible, according to the invention, only if the ejection lever 100 is in the ejection position.

The electrical portion 30 of the opening control 10 according to the invention will now be described with reference to FIGS. 19 to 22. The electrical portion 30 forms an electric actuator 30 of the opening control 10 and comprises an electric control mechanism referred to by the general reference 400. According to the invention, the electric actuator 30 is connected to the pivot means 450 to electrically displace the lever 100 between at least handle blocking and ejection positions in an electrical operating mode.

The electrical portion 30 comprises a casing 402 and the control mechanism 400 is housed within the casing 402. The casing 402 is connected to a cap 404 by screws 406, but other mechanical assembly means may be used. Preferably, the casing 402 and the cap 404 delimit a tight internal volume.

Figure 19:
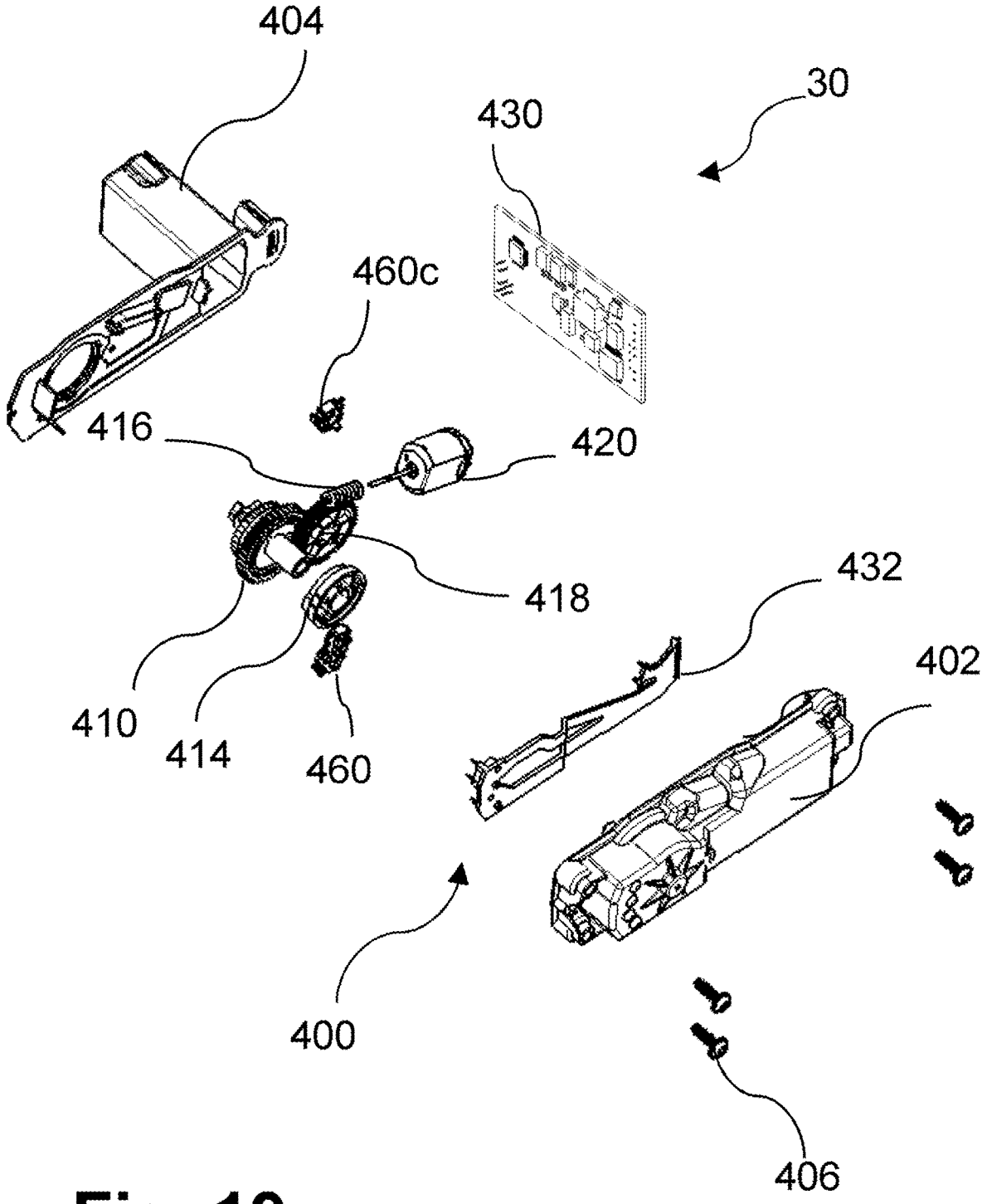
FIG. 19 represents an exploded perspective view of the electrical portion of the opening control of FIG. 1.

In this example, the electric mechanism 400 comprises a command wheel 410, a toothed wheel 412, a control wheel 414, a worm screw 416 as well as a transmission wheel 418. The command wheel 410 is intended to be driven by the transmission wheel, in turn driven by the worm screw 416, which is rotatably driven by an actuation motor 420 as shown in FIG. 19.

The actuation motor 420 is connected to an electronic board 430 by overmolded electrical connection tracks 432 or other electrical connection means. The electronic board 430 is a component of the opening control 10 and is connected in turn to a calculator of the vehicle, which is not represented. The actuation motor 420 is controlled by the electronic board 430.

The command wheel 410 has three operating positions corresponding to the illustrated configurations M0, S and M1 of FIG. 4 and the different electrically controlled movements of the handle may take place between these three operating positions.

In a preferred embodiment of the invention, the actuation motor 420 is connected to the command wheel 410 by the worm screw 416 and the transmission wheel 418. The actuation motor 420 controls the command wheel 410 which in turn positions the ejection lever 100 via a set of cams 450 described hereinafter (FIG. 20) which cooperate respectively with the internal 180 and external 160 profiles of the ejection lever 100 and which the ejection lever cam 172, so as to impart a rotational movement of the ejection lever 100 about its axis of rotation 80.

Those skilled in the art understand that the transmission between the motor and the ejection lever 100 may be achieved in several manners (bevel gears, planetary gears, helical gears, hinged levers, etc.). Moreover, the invention may include any type of linear or rotary electrical drive (brushed motors, brushless motors, stepper motors, solenoid, piezo motors, cylinders, etc.)

Depending on the request of the calculator of the vehicle, the actuation motor 420 can position the command wheel 410 in three positions corresponding to the three configurations S, M1 or M0 in order to achieve the ejection, the retraction or the blocking of the handle electrically.

In order to obtain this operation type, the actuation motor 420 is preferably piloted by pulse width modulation (PWM) in order to obtain a suitable rotational speed to obtain a controlled positioning and which confers a pleasant acoustic and visual sensation to the user.

Preferably, the command wheel 410 is capable of turning integrally with the control wheel 414, rotatably connected by a flattened portion 416 or any other rotational drive system. The external surface of the control wheel 414 has over its circumference surfaces more or less radially away from the axis of the wheel and which enable an indexation of the three positions corresponding to the operating configurations S, M0 and M1.

According to the invention, the lever 100 and the pivot means 450 are capable of mechanically cooperating so as to disengage the lever 100 from the blocking means 300 and to cause the automatic return of the lever 100 back into its ejection position, both in a manual operating mode by pushing the handle 60 from its leveled position so as to drive the ejection lever 100 in rotation in the reverse direction of the ejection direction of rotation and in an electrical mode by electrically rotating the pivot means 450 by the electric actuator 30.

Preferably, the pivot means 450 comprise a set of cams 450 comprising at least one cam.

Figure 20:
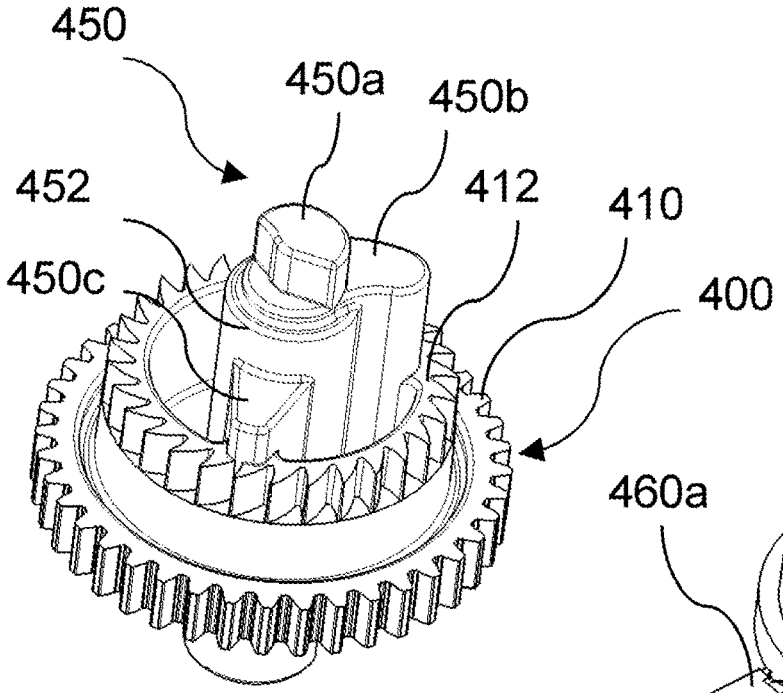
FIGS. 20 to 22 are perspective views of an electric mechanism of the electrical portion represented in FIG. 19.
Figure 21:
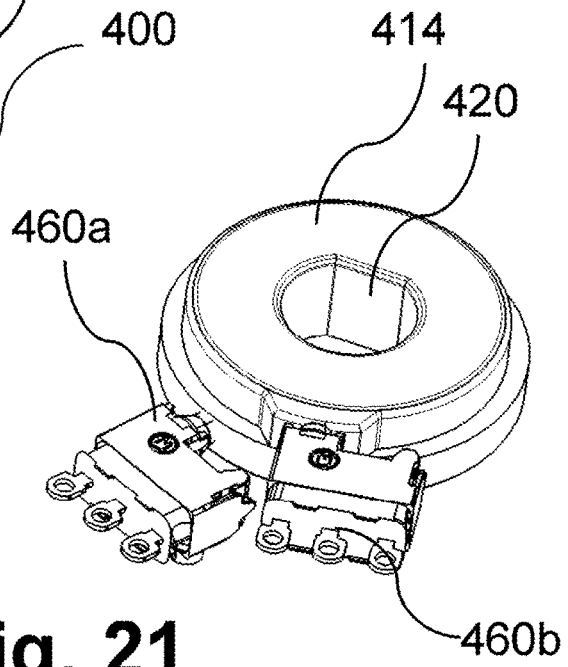

This set of cams 450 comprises a cams pin 452 on which are preferably mounted, in a secured manner, the command wheel 410, the toothed wheel 412 and the control wheel 414. In this example, the set of cams 450 includes three cams:

- a first cam 450*a*, called ejection cam, located at the end of the cam axis 452,
- then, respectively at an increasing distance with respect to this end, a second cam 450*b*, called retraction cam, end
- a third cam 450*c*, called clutch cam, (FIG. 20).

These three cams 450*a*, 450*b*, 450*c* are axially separated and have different shapes and radial dimensions. The rotation of the cam axis 452 simultaneously displaces the three cams, which will act on the ejection lever 100 as described later on. The cams set 450 is intended to be inserted inside the ejection lever 100 throughout the openings of the ejection lever 100 as well as throughout the internal lever 60*b*.

The first cam 450*a* lies substantially at an end of the cam axis 450 and has a radius smaller than or equal to the radius of the cam axis 452. We see in particular in FIGS. 23A to 23D that the first cam 450*a* is intended to lie in the same plane as the toggle 150 and the ejection lever pawl 320. Preferably, the ejection cam 450*a* is movable in rotation relative to the casing 50 about the cam axis 452 and has a guide surface configured to releasably cooperate with the lever 100 by guiding the drive member 150 against the ejection cam 450*a*.

Preferably, the lever 100 and the pivot means 450 comprise declutching mechanical coupling means. In the described example, these declutching mechanical coupling means comprise the drive member 150 and the ejection cam 450*a*. Thanks to these declutching means, the opening control 10 can adopt a blocked-leveled handle configuration M0 in which the mechanical coupling is declutched, an unblocked-leveled handle configuration S in which the mechanical coupling is clutched and an ejected handle configuration M1. Preferably, the switch from one configuration to another is achieved in the electrical mode and/or in the manual mode. In the declutched state, a manual push action on the handle 60 cannot result in the ejection of the handle. Thus, the ejection of the handle is blocked. However, in the clutched state, the handle can be ejected by a simple manual push.

Thus, preferably, in the configuration M0, the member 150 and the cam 450*a* are sufficiently spaced apart from each other to prevent the disengagement of the lever 100 by pushing the handle 60 and in the unblocked-leveled configuration, the member 150 and the cam 450*a* are sufficiently close to each other to enable the disengagement of the lever 100 by pushing the handle 60.

In this example, the second cam 450*b*, called retraction cam, is movable about the cam axis 452 and has a guide surface configured to make the lever 100 pivot from the ejection position to the blocking position in the electrical operating mode.

Moreover, the guide surface of the retraction cam 450*b* is also configured to forcibly guide, against an impediment to the automatic return of the lever 100 back into the ejection position, for example because of icing, the ejection of the handle 60 by electrical actuation of the cam 450*b* in the reverse direction of the retraction direction.

Furthermore, in the described example, the clutch cam 450*c* is also movable about the cam axis 452. The cam 450*c* is connected to the actuator 30 and has a guide surface shaped so as to cooperate with the internal profile 160 of the lever 100 in order to position it in the configuration S for example from the configuration M0.

Furthermore, the internal profile 160 is shaped so that the clutch cam cooperates with this profile 160 in order to control the automatic return movement of the lever 100 back into its ejection position.

In addition, the electric mechanism 400 comprises two micro-switches 460*a* and 460*b* in mechanical contact with the control wheel 414 which are adapted to detect the rotational position of the cam axis 452 and consequently the position of the cams 450*a*, 450*b* and 450*c*. The two micro-switches 460*a* and 460*b*, away from each other, are in contact with the control wheel 414 and electrically connected to the electronic board 430 (FIG. 19) of the opening control 10 according to the invention. Those skilled in the art know the operating principle of this type of micro-switches.

The micro-switches 460*a* and 460*b* transmit the information on their actuation state to the electronic board 430, which, if an order is given by the calculator, gives an instruction to the motor, which, depending on the received order, then stops the movement of the command wheel 410 when the cams 450*a*, 450*b* and 450*c* are in predefined positions.

Figure 27A:
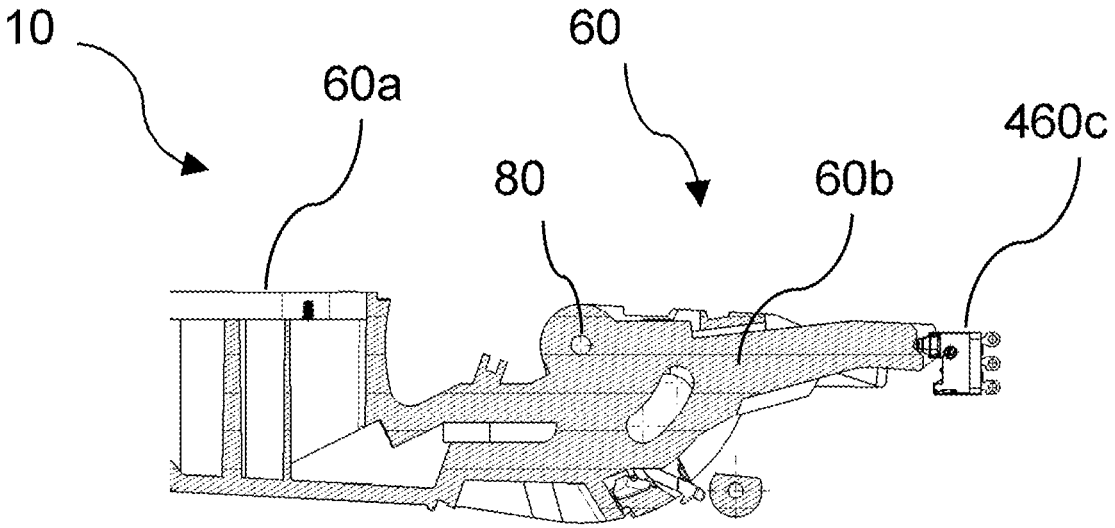
FIGS. 27A and 27B show sectional views of the internal and external levers and of a micro-switch of the electrical portion of the opening control according to the invention.
Figure 27B:
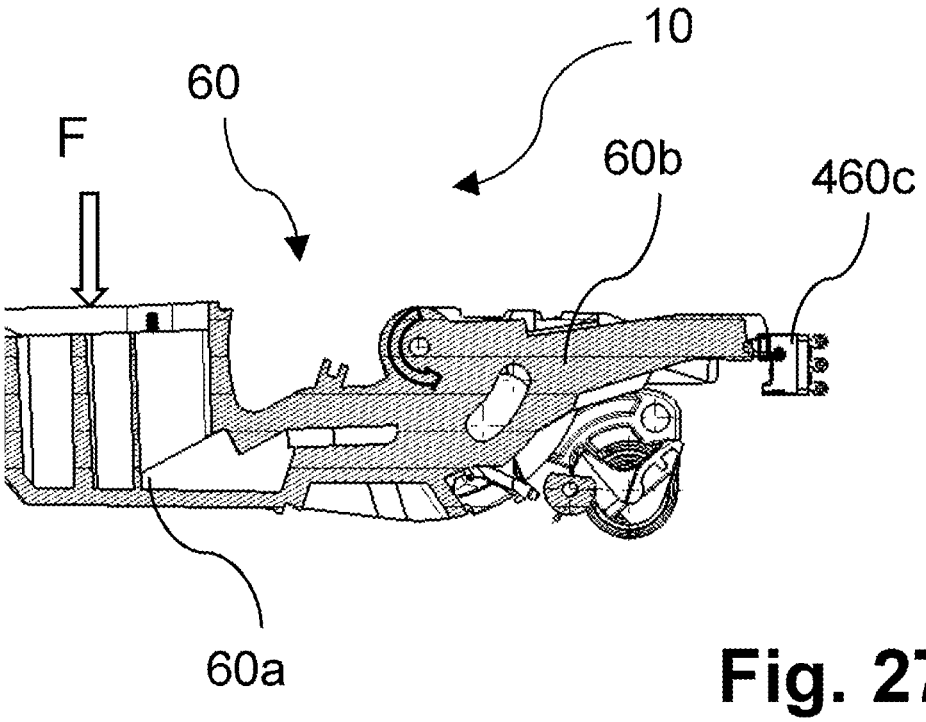

Another opening order detection micro-switch 460*c*, fastened on the cap 404 (FIG. 2) is activated by the end of the internal lever 60*b* when, starting from the leveled position (FIG. 27A), the user exerts a push F on the external lever 60*a*, partially represented, inwardly of the door and makes the handle turn in the counterclockwise direction about its axis 80 (FIG. 27B). This opening order detection micro-switch 460*c* is connected to the electronic board 430 of the opening control 10 according to the invention. It is also possible to place a micro-switch to be accessible from the outside, and then the user can activate it by touching it and thus controls the ejection of the handle, in the same manner as a push-button.

In the described example, the two micro-switches 460*a* and 460*b* operate in the following manner:

configuration M0, the two micro-switches are inactivated and the electronic board 430 is informed that the handle is leveled and blocked;

configuration M1, only one of the micro-switches is activated and the electronic board 430 is informed that the lever 60*a* is ejected;

configuration S, the two micro-switches 460*a*, 460*b* are activated and the electronic board 430 is informed that an ejection of the handle 60 is possible.

In the configuration M0, the command wheel 410 is in a first position, the two micro-switches 460*a*, 460*b* are inactivated and the electronic board 430 is informed that the handle levels with the body and that is blocked. The configuration M0 corresponds to a handle leveled with the body and blocked for an unauthorized person, when the car is parked, or is running, or in order to avoid an unintentional opening of the door. If the command wheel 410 is in this first position and the user presses on the external lever 60*a*, the external lever 60*a* remains immobile.

In the configuration M1 corresponding to a handle in the ejection position (FIG. 3C), the command wheel 410 is in a second position, one of the micro-switches 460*a*, 460*b* is activated, the other is inactivated, and the electronic board 430 is informed that the lever 60*a* is in the ejection position.

Once the external lever 60*a* is in the ejection position (FIG. 3C), the user can grab it and continue the rotation of the lever outwardly of the door (FIG. 3D) until the «door opening» position to unblock the latch and to open the door. Starting from this last position of the external lever, when the user releases the external lever 60*a*, the latter returns back into the ejection position (FIG. 3C).

When the command wheel 410 is in the third position corresponding to the configuration S, the two micro-switches 460*a*, 460*b* are activated and the electronic board 430 is informed that an ejection of the handle is possible. The position S corresponds to the handle leveled with the body and in which the user can activate the ejection of the handle:

either by a manual push action F of the lever 60*a* inwardly of the door which will actuate the opening order detection micro-switch 460*c*. Thus, when the user presses on the external lever 60*a*, the external lever 60*a* slightly returns into its casing (FIGS. 3B and 27B), that is to say up to the «pushed lever» or «push» position, the opening detection micro-switch 460*c* is actuated and then triggers an ejection mechanism which displaces the lever 60*a* out of its casing 50.

or by an order sent to the calculator of the vehicle by a remote control.

The return from the ejected configuration M1 to the unblocked-leveled configuration S, that is to say the «retraction» may take place:

either manually by a push on the handle by the user until the unblocked-leveled position S which triggers the blocking of the ejection lever 100, or via a rotation of the cam axis piloted by an order sent by the calculator of the vehicle up to the position S or M0 depending on the sent order. This retraction may be provided in different manners, for example, either via an order sent by a remote-control, or after reaching a predefined running speed, for example 7 kilometers per hour, or after a predefined given time period, for example twenty seconds after the beginning of the ejection.

Considering the possibilities of the invention, it is possible, for example, to favor the operation between the configurations M0 and M1, that is to say an electric ejection and retraction, and keep the mode S, which allows a purely mechanical ejection, when the calculator of the vehicle detects a low battery level.

Figure 23A:
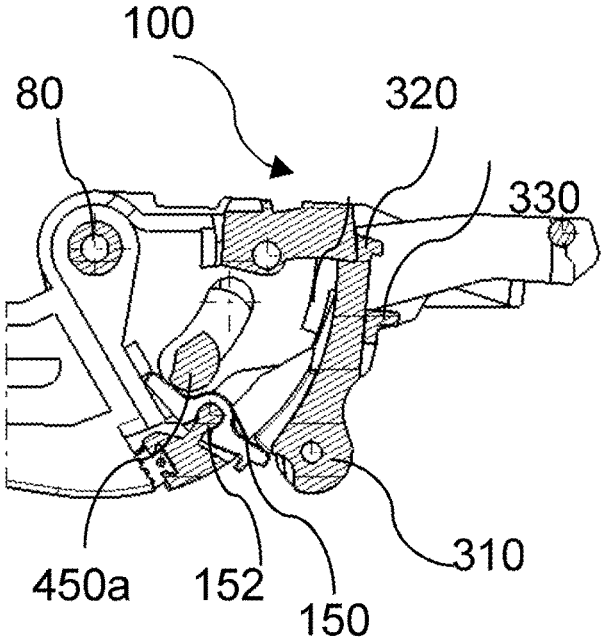
FIGS. 23A to 25B show sectional views of the ejection lever of FIG. 7 cooperating with a set of cams of the electric mechanism of FIGS. 20 to 22 illustrating operating steps of the opening control according to the invention.
Figure 23B:
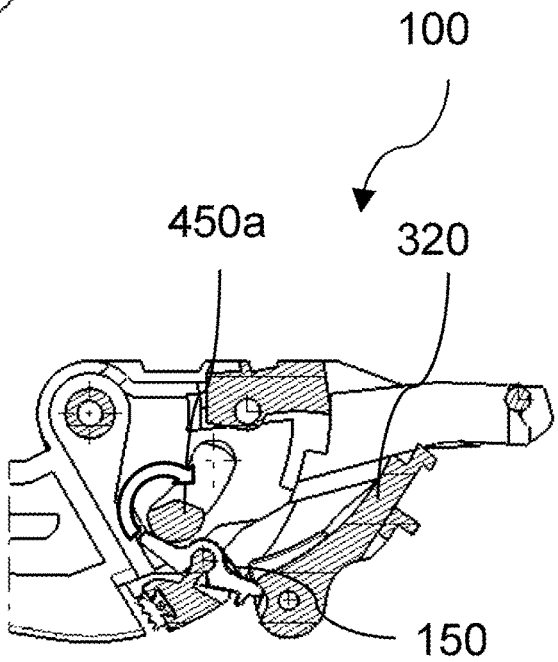
Figure 23C:
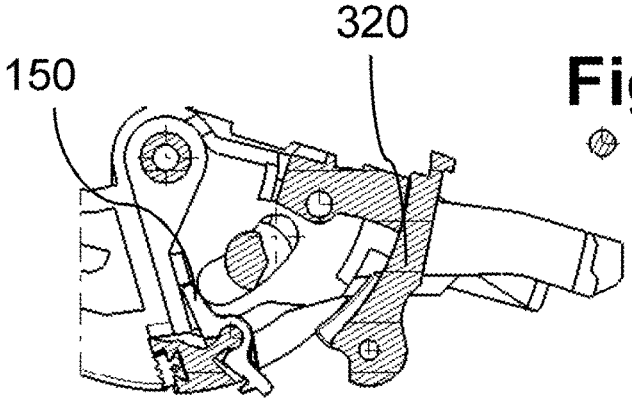
Figure 23D:
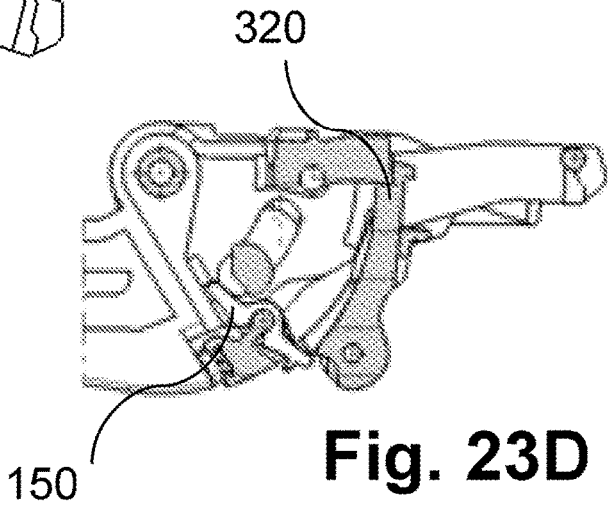

The operation of the cams set 450 will now be described with reference to FIGS. 23A to 25B. FIG. 23A illustrates the configuration S, FIG. 23C illustrates the configuration M1 and FIG. 23D illustrates the configuration M0. FIG. 23B illustrates a transitional operating configuration.

Referring to FIGS. 23A to 23D, the function of the first cam 450*a* is to drive the toggle 150 in rotation, which then releases the ejection lever pawl 320, which in turn releases the ejection lever 100 and thus allows unblocking the handle 60.

This rotational driving of the toggle 150 may be achieved in two ways starting from the configuration S illustrated in FIG. 23A:

either by a push of the user on the lever 60*a* inwardly of the door, which will thus make the handle pivot in the counterclockwise direction and thus bring the toggle 150 close to the cam 450*a* and make the toggle 150 pivot;

or by an electrically activated rotation of the command wheel 410 and of the cam axis 452, in the clockwise direction according to FIG. 23A and which will then result in a pivoting of the toggle 150 (FIG. 23B), an unblocking of the ejection lever pawl 320 and a rotation of the ejection lever 100 and of the lever 60*a* in the counterclockwise direction up to an ejection position of the handle, that is to say the configuration M1 of FIG. 23C.

In the configuration M0 (FIG. 23D), it should be noted that the distance between the cam 450*a* and the toggle 150 is too large for a manual push on the handle resulting in a pivoting of the toggle 150 which will therefore makes the ejection of the handle impossible. In this example, this configuration M0 corresponds to the declutched state of the declutching coupling means.

When the action tending to make the toggle 150 pivot ceases, the first torsion spring 322 tends to return the ejection lever pawl 320 back into its rest position, but the pawl retaining lever 340 blocks the return of the ejection lever pawl 320, thereby enabling the free rotation of the ejection lever 100 and of the lever 60*a* towards an ejected handle position. Similarly, the handle blocking pawl 330 will be retained, because its transverse branch 334 is blocked in the counterclockwise direction by the ejection lever pawl 320 (FIGS. 13A, 13B, 16A and 16B).

Figure 24A:
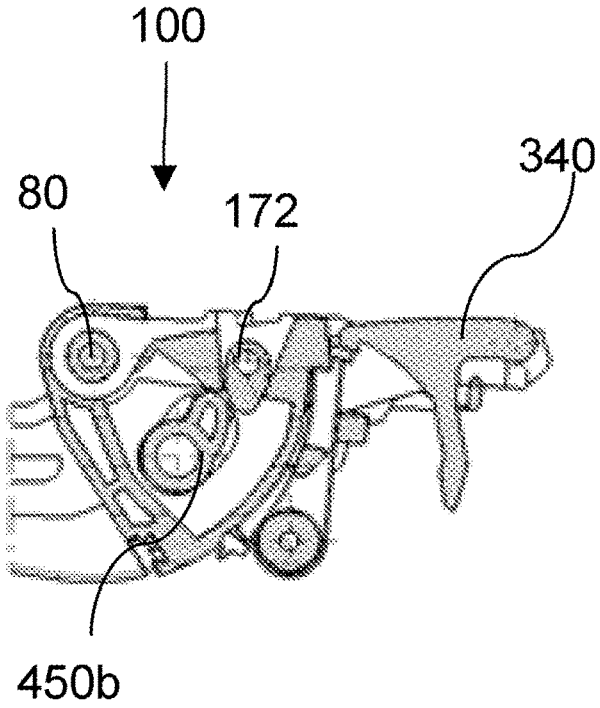
Figure 24B:
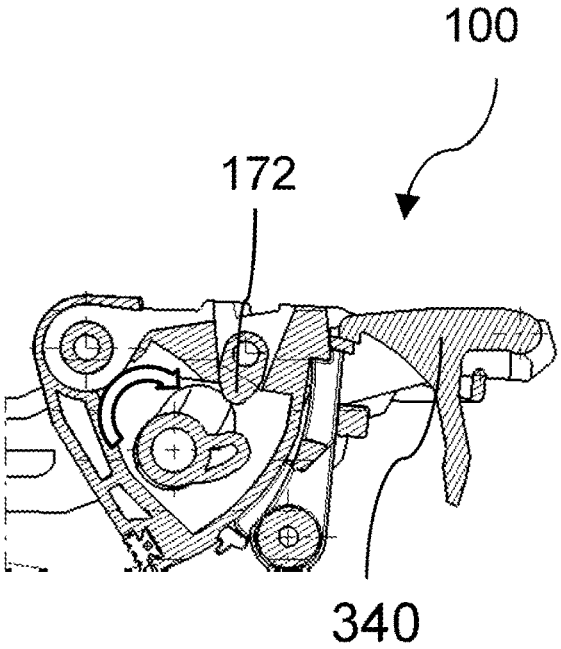
Figure 24C:
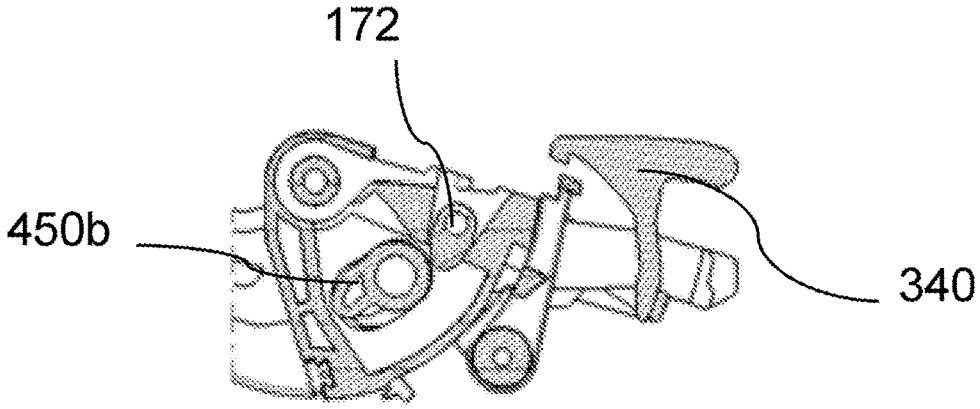

Referring now to FIGS. 24A to 24C, the operation of the second cam 450*b* will be described. FIG. 24A illustrates a configuration M0, FIG. 24B illustrates a configuration S and FIG. 24C illustrates a configuration M1.

In the example, the second cam 450*b* is in an intermediate axial position between the cam 450*a* and the cam 450*c* on the cam axis 452 and its radial dimensions are larger than those of the first cam 450*a*.

In FIG. 24A, the command wheel 410 is in the configuration M0, the second cam 450*b* is in the same plane as the ejection lever cam 172 and the internal profile 210 of the ejection lever 100.

The ejection lever cam 172 is a cam rotating about the axis 170, by 5° to 15°, and which is intended to cooperate with the second cam 450*b* of the command wheel 410.

During the rotation of the cam 450*b* in the clockwise direction according to FIG. 24A for the switch from the configuration M0 (blocked-leveled) to the configuration S (unblocked-leveled), the shape of the cam 450*b*, that of the ejection lever cam 172, and the freedom of rotation of the ejection lever cam 172 enables the free movement of the command wheel 410 from the configuration M0 to the configuration S, yet without triggering the ejection of the ejection lever 100. The same applies for switching from the configuration S to the configuration M0, by a rotation in the counterclockwise direction, the second cam 450*b* will turn freely without driving the ejection lever cam 172.

Conversely, in order to switch from the ejected configuration M1 to the configuration M0 (retraction and blocking), via the configuration S, the second cam 450*b* will drive the ejection lever cam 172, and displace the ejection lever 100 by making it turn in the counterclockwise direction and thus enable the blocking of the ejection lever 100 by the pawl 320, the handle 60 also turns in the counterclockwise direction until being retained by the handle blocking pawl 330 (FIGS. 24C and 24A).

The function of the lower profile 180 is to pilot the switch from the configuration S (FIG. 24B) to the position M1 (FIG. 24C). Indeed, after the release of the ejection lever pawl 320, by the pivoting of the toggle 150, in turn actuated by the rotation of the cam 450*a*, the ejection lever spring 160 pushes the ejection lever 100 towards the lower bearing wall 64 of the external lever 60*a* and drives the ejection lever 100 and the handle 60 in a clockwise rotation, up to an ejected configuration M1.

The second cam 450*b* has two functions:

Forcing the ejection in the casing where there are obstacles to the ejection which is performed by the spring of the ejection lever (for example ice) when the command wheel 160 therefore switches from the configuration S to the configuration M1;

Carrying out the retraction of the ejection lever 100 when the command wheel 410 switches from the configuration M1 to the configuration S or M0, by a reverse movement of the cam 450*b*, in the counterclockwise direction according to FIG. 24C.

Figure 25A:
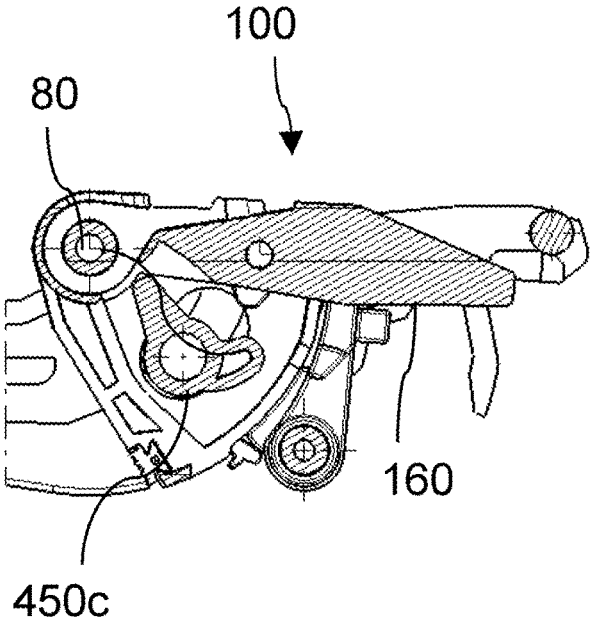
Figure 25B:
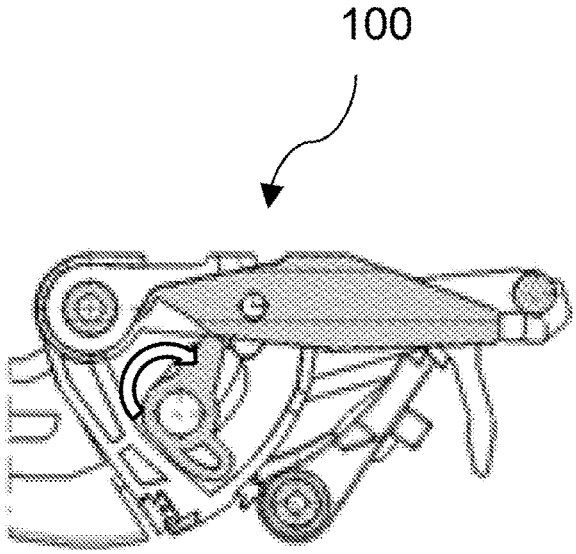

Referring now to FIGS. 25A to 25B, the operation of the third cam 450*c* will be described. FIG. 25A illustrates a configuration M0.

The third cam 450*c* is in the farthest position from the tip of the cam axis 452, close to the toothed wheel 169, and its largest radius is greater than that of the first cam 450*a* and than that of the second cam 450*b*.

In FIG. 25A, we see that the third cam 450*c* of the command wheel 410 and the upper profile 160 of the ejection lever 100 lie in the same plane.

When the command wheel 410 switches from the configuration M0 to M1, and therefore turns in the clockwise direction according to FIG. 25A, the function of the third cam 450*c* is to slightly displace the ejection lever 100 in the reverse direction of the ejection at first in order to enable the toggle 150 (FIGS. 25B and 23B) to get close to the ejection lever pawl 320, to trigger the ejection lever pawl 320 and to accompany the ejection of the ejection lever 100 at a controlled ejection speed pleasant to the user.

If the vehicle suffers from an electrical failure when the command wheel 410 is in the first position of the configuration M0, the command wheel 410 cannot be displaced and the user will not have access to the motor vehicle.

Figure 22:
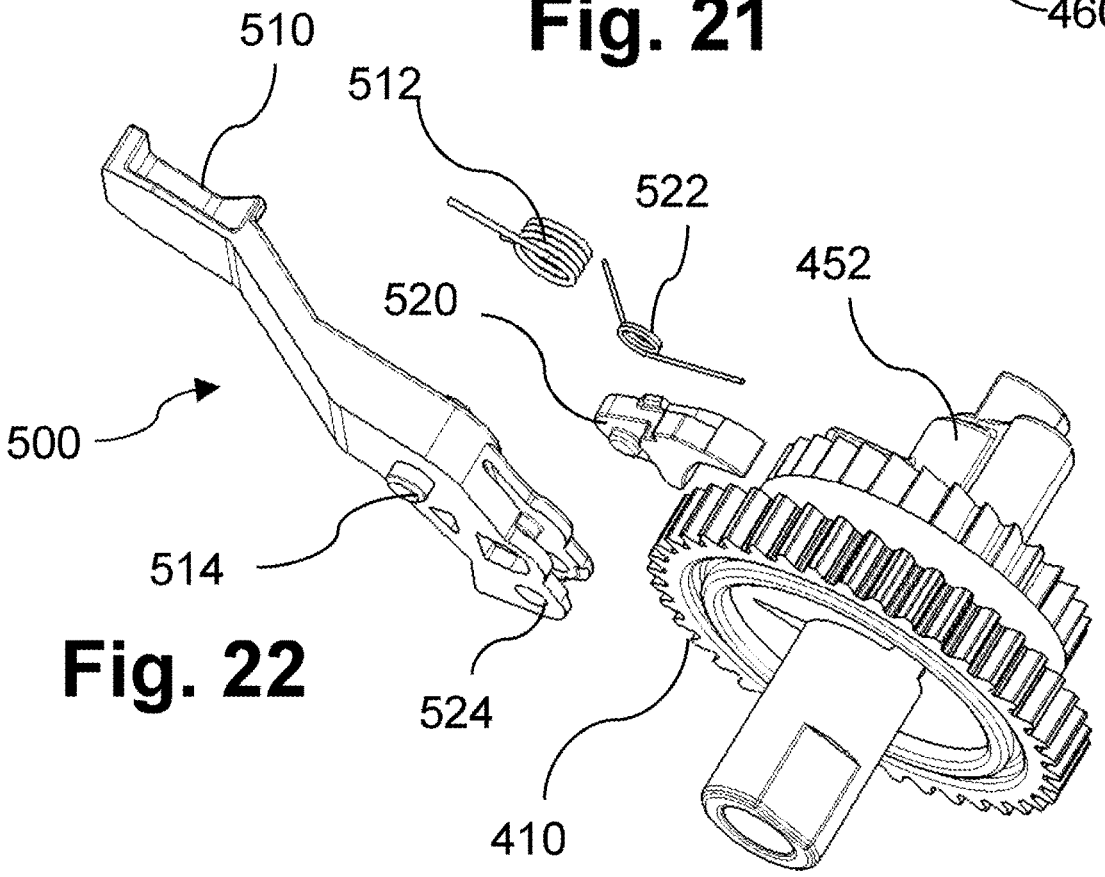
Figure 26:
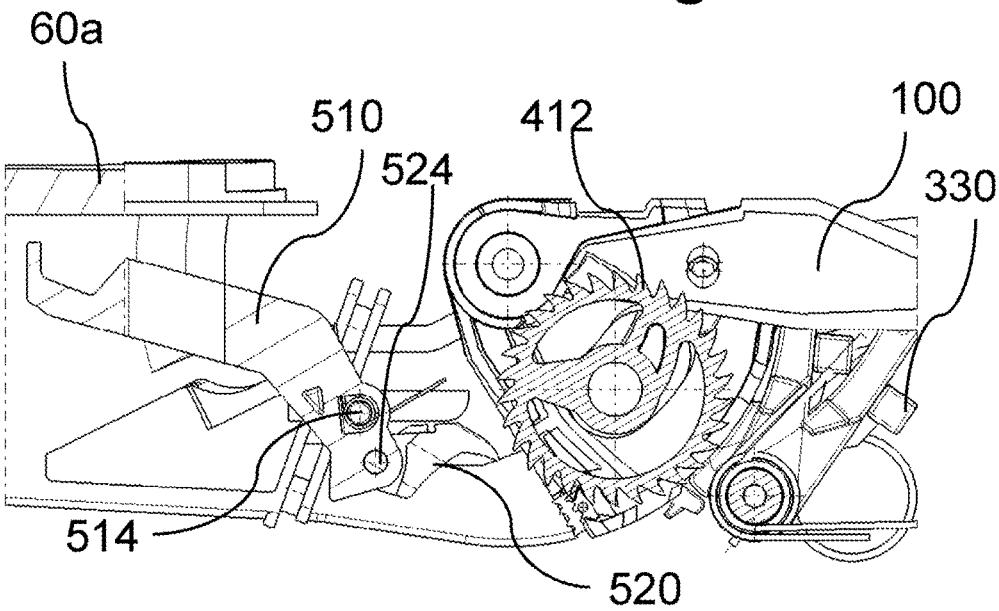
FIG. 26 shows a sectional view of the handle illustrating an unblocking mechanism.

In order to solve this problem, the opening control 10 according to the invention is provided with an unblocking mechanism 500 illustrated in FIGS. 22 and 26. FIG. 5 shows a lock-cover 502, that is to say a cap, which hides a lock and/or a tab. During an electrical failure, when the command wheel 410 indicates the blocked position M0, the user must use a tab or a tool (not represented) in order to actuate the unblocking mechanism by introducing this tool, for example, in a space formed to this end between the opening control and the body. The tab may be hidden, beneath the lock-cover 502 but other options can also be considered, for example, it is possible to connect this tab to a mechanism which is activated when the user turns the key in the latch lock of the door of the vehicle, not represented, and which is herein located beneath the lock-cover 502, and whose location 504 is seen in FIG. 5.

It is also possible to consider making the tab accessible in a space formed between the handle and the body Referring to FIGS. 22 to 26, the unblocking mechanism 500 comprises a safety opening lever 510, a safety opening pin 520, a safety opening pin spring 522 and a safety opening lever spring 512. The safety opening lever 510 is connected to the handle 60 via its axis of rotation 514.

The safety-opening pin 520 is connected to the safety-opening lever 510, by its axis of rotation 524. When the user actuates the safety opening lever 510 by making it pivot about its axis of rotation 514, the latter drives the safety opening pin 520 which then cooperates with the toothed wheel 412 which has the same axis 452 as the command wheel 410, and makes the command wheel 410 turn in order to make it come out from the blocking position M0. Possibly, the user should repeat the unblocking action several times until obtaining the sufficient angular rotation to be able to unblock the ejection of the ejection lever 100.

Those skilled in that art understand that the unblocking mechanism may be designed otherwise, provided that it operates during an electrical failure, and that it is arranged such that the user of the vehicle can operate it from the outside of the vehicle.

The external lever 60*a* according to the invention is provided with a dampening mechanism 90 connected to the casing and illustrated in FIG. 5. This mechanism 90 comprises a stop body 92, an elastomeric stop 94 and a stop spring 96. This spring 96 acts on the handle in the ejection direction. The spring 96 then pushes on the stop body 92, which is provided with the elastomeric stop 94, whose function is to press on the lever 60*a*.

A first function of this mechanism, when running, is to prevent the lever 60*a* from being displaced towards the direction of activation and unblocking of the ejection lever 100, in the event of vibrations or a brutal closure of the door. A second function is the accurate angular setting of the position of the lever 60*a* leveling with the body, that is to say the setting of the leveling, which is achieved by screwing between the stop 94 and the stop body 92. A third function is to dampen the return of the handle at the end of retraction.

The description hereinafter explains the main aspects of operation, both mechanical and electrical, of the opening control 10 according to the invention. Reference may be made in particular to the general operation diagram of FIG. 4.

When the lever 60*a* is in the configuration S (unblocked-leveled), the user can cause the ejection of the handle (configuration M1):

- either by pressing on this lever 60*a*, by pushing it slightly inwardly of the door which actuates the micro-switch 460*c* and gives the ejection order to the calculator,
- or by sending an order to the calculator via a remote-control,
- or, in the event of an electrical failure, by exerting a strong push on the handle lever, which will allow disengaging the ejection lever pawl 320 and releasing the ejection lever 100.

In the three previous case, the cam 450*a* is brought into contact with the toggle 150 and makes it pivot, thereby resulting in the rotation of the ejection lever retaining pawl 320 and therefore the release of the rotation of the ejection lever 100 and of the handle 60*a* about the axis of rotation 80 and which are driven in rotation outwardly of the door under the action of the ejection spring 40 (FIG. 23C).

Indeed, when the ejection lever 100 is released, the spring 40 of the ejection lever 100 makes it turn. The ejection lever 100 and the lever 60*a* then turn together about the common axis 80, while in contact with each other via the noise-insulating stops 132 placed on the lower branch 130 of the ejection lever 100.

When the external lever 60*a* is ejected (FIG. 3C), the user can grab the external lever 60*a*, and continue the rotation of the lever 60*a* in order to trigger the latch and open the door (configuration M2).

Figure 17A:
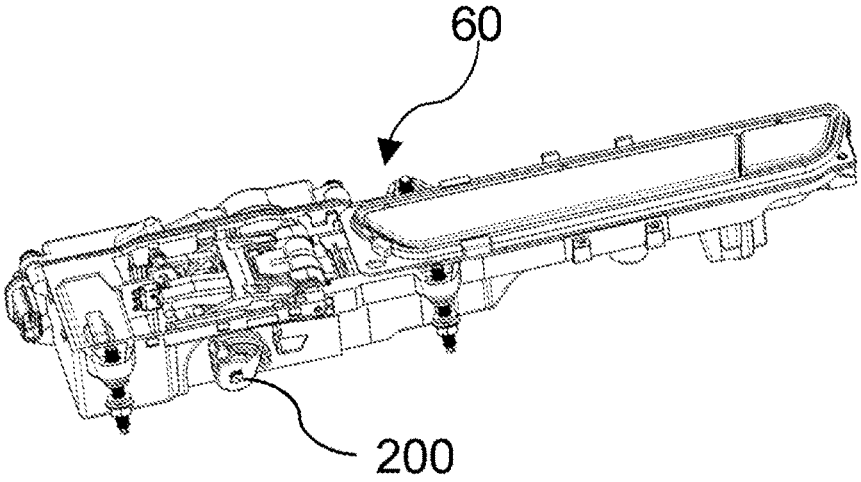
FIGS. 17A to 18B are perspective views of a mechanism of the opening control according to the invention.
Figure 17B:
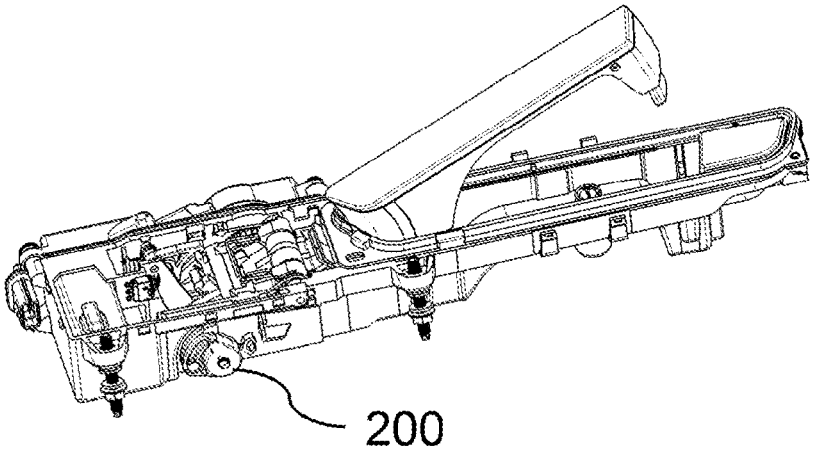
Figure 18A:
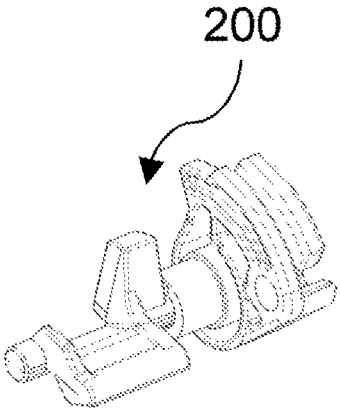
Figure 18B:
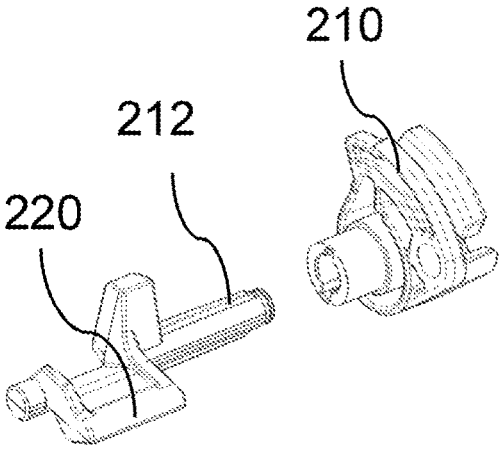

When the user pulls the external lever 60*a* to unlock the latch and open the door, the ejection lever 100 remains immobile, because the upper branch 120 liking the two cheeks 110*a* and 110*b* is blocked by abutting against the casing 50. The lever 60*a* then turn about the common axis 80 against the action of the handle return spring 160 namely up to the opening position and the user can open the door (FIGS. 3D and 17B).

When the user has opened the door, he releases the external lever 60*a*. At that moment, the handle return spring 160 makes the lever 60*a* turn until its lower bearing wall 64 rests again against the lower branch 130 of the ejection lever 100 and against the sound-insulating stop(s) 132, and closes the space between these two elements, thereby returning back to the ejected handle position M1.

The switch from the ejected configuration M1 to the unblocked-leveled configuration S, namely a retraction, may then be done:

- either by a rotation of the command wheel 410 upon an order of the calculator,
- or by a simple manual push exerted by the user bringing the handle back into the leveled position.

When the command wheel 410 is in the configuration M0, the external lever 60*a* is leveled with the body and is blocked. If the user presses on the lever 60*a*, the latter pushes the ejection lever 100 via the sound-insulating stops 132. The ejection lever 100 turns in the counterclockwise direction (FIG. 27B). However, in this position, as shown in FIG. 23D, there is no possible contact between the cam 450*a* and the toggle 150.

Indeed, in this case, the toggle 150 cannot displace the ejection lever pawl 320, which holds the ejection lever 100 blocked. Therefore, the ejection lever 100 is not ejected. The configuration M0 blocking function may be used when the vehicle is parked or running at a speed higher than a predetermined value, for example seven kilometers per hour. The calculator of the car, which is connected to the gearbox and to the electronic board 430, sends a message to the electronic board 430, which gives an order to the motor to make the command wheel 320 turn to the blocked-leveled position M0. The first cam 450*a* connected to the command wheel 410 is then brought away from the toggle 150 and therefore the ejection lever pawl 3220 and the handle blocking pawl 330 remain in the blocking position and block the ejection lever 100 and the handle 60 which cannot be ejected.

The switch from the blocked configuration M0 to the unblocked configuration S, and vice-versa is done by the already described rotations of the control axis. The switch from M0 to S may also be done manually in the event of an electrical failure.

According to the invention, the user therefore has the possibility to emit a handle ejection order via a push manually exerted as before, but also via a remote control (via a mobile phone, a key, etc.). In this case, the ejection (or blocking) order first passes to the calculator of the car, which transmits this order to the electronic board 430 of the opening control according to the invention, and which in turn will give the activation order of the motor 420, thereby causing the ejection of the handle afterwards according to a process which will be described later on.

A possible variant of the invention is to hide the lock directly beneath the external lever 60*a*, without a lock-cover 911, or still have a visible lock on the leveled handle door and disposed in the proximity of the external lever 60*a*, finally a last possibility would be an opening control according to the invention, without a lock.

Another variant of the invention is to set up and fasten the electrical portion 30 not only on one side as represented in FIGS. 1 and 2, but on several sides, for example on either side of the casing 50. Any other set-up of the electrical portion 30 can be also considered, such as for example a rotation by 180° of the electrical portion 30 about the cam axis 420.

A variant consists in two sets of cams 450*a*, 450*b*, 450*c* placed at each side of the ejection lever with a common transmission shaft in order to make the opening control symmetrical. This symmetrical arrangement aims at reducing the torsion and the bending to which the cam axis is subjected. Thus, the service life of the mechanism is increased. A similar effect may be obtained by rotatably guiding the end of the cam axis in the casing 50.

Those skilled in the art understand that the positioning detection means comprising micro-switches may be replaced with means comprising a Hall-effect sensor, a capacitive sensor, or any other detection means filling the same function.

Those skilled in the art understand that the electrical portion and the mechanical portion may be located with respect to each other in several manners.

The opening control may comprise means for making the handle come out with a mechanism connected to the lock by turning the key in the latch of the car.

Those skilled in the art understand that the main module may be made with different types of reduction motors, for example a motor with an epicyclical reduction, a motor with a worm screw reduction, a motor with a spur gears reduction, motors with bevel gears reduction.

The invention claimed is:

1. An opening control for a door leaf of a motor vehicle, the opening control comprising: a casing intended to be fastened to the door leaf and a handle configured for gripping by a user, movable in rotation relative to the casing between at least:

a leveled position in which the handle is entirely or partially housed within the casing, an ejection position in which the handle is at least partially protruding from the casing, so that the user can grab the handle and open the door leaf, an opening position, in which the handle has caused the unlocking of the door leaf, further comprising a lever for ejecting the handle connected to the handle by at least one common axis of rotation, pivot means for pivoting the lever about the at least one common axis of rotation and an electric actuator connected to the pivot means so as to electrically displace the lever between at least one blocking position and a lever ejection position corresponding to the ejection position of the handle, wherein the opening control further comprises a biasing member connected to the lever and configured to automatically return the lever from the at least one blocking position towards the ejection position according to an ejection direction of rotation and blocking means for blocking the lever in the at least one blocking position and in that the lever and the pivot means are capable of mechanically cooperating so as to release the lever from the blocking means and cause the automatic return of the lever back into the ejection position, both by mechanical actuation by pushing the handle from the leveled position so as to drive the lever in rotation in a direction opposite to the ejection direction of rotation and by electrical actuation of the pivot means by the electric actuator.

2. The opening control according to claim 1, wherein the lever and the pivot means are capable of mechanically cooperating to displace the lever in the ejection direction or in the direction opposite to the ejection direction by electrical actuation of the pivot means by the electric actuator from any position of the lever.

3. The opening control according to claim 1, wherein the lever comprises a drive member for driving the blocking means, wherein the drive member is arranged to cooperate with the pivot means by a releasable mechanical connection and to drive the blocking means into a disengagement position in which the blocking means is disengaged from the lever.

4. The opening control according to claim 3, wherein the drive member comprises a toggle rotatably attached to a head connected to the lever and arranged to drive the blocking means by a tipping over caused by the mechanical cooperation with the pivot means.

5. The opening control according to claim 3, wherein the pivot means comprise an ejection cam movable in rotation relative to the casing about a cam axis, which has a guide surface configured to releasably cooperate with the lever by guiding the drive member against the ejection cam.

6. The opening control according to claim 1, wherein the lever and the handle are connected by a handle return spring capable of exerting a force for returning the handle towards the lever.

7. The opening control according to claim 1, wherein the blocking means of the lever comprise an ejection lever pawl subjected to an elastic return, which urges the lever pawl into an engagement position in which the ejection lever pawl engages the lever.

8. The opening control according to claim 7, comprising a second lever for retaining the lever pawl configured to retain the lever pawl in a releasing position in which the ejection lever pawl releases the lever against the elastic return.

9. The opening control according to claim 7, comprising a blocking pawl for blocking the handle, wherein the blocking pawl is subjected to an elastic return, which urges the blocking pawl into an engagement position in which the blocking pawl engages the handle.

10. The opening control according to claim 9, wherein the blocking pawl and the lever pawl are arranged on a common axis so that the ejection lever pawl is capable of blocking the lever while the blocking pawl is not in engagement with the handle.

11. The opening control according to claim 1, wherein the lever and the pivot means are capable of adopting a configuration (M0) corresponding to the leveled position of the handle and the at least one blocking position of the lever, a configuration (S) corresponding to the leveled position of the handle and the lever ejection position of the lever and an ejected configuration (M1) corresponding to the ejected position of the handle, a switch from one configuration to another being achievable by electrical and/or mechanical actuation.

12. The opening control according to claim 11, comprising means for detecting information relating to a configuration (M0, M1, S) of the pivot means and the lever and means for transmitting the information to the electric actuator.

13. The opening control according to claim 11, wherein the lever and the pivot means comprise declutching mechanical coupling means operating so that in the blocked-leveled handle configuration (M0) the declutching mechanical coupling means is declutched and in the unblocked-leveled handle configuration (S), the declutching mechanical coupling means is clutched.

14. The opening control according to claim 13, the declutching mechanical coupling means comprising a drive member of the lever and an ejection cam, in the blocked-leveled handle configuration (M0), the drive member and the ejection cam are sufficiently spaced apart from each other to prevent the disengagement of the lever from the blocking means by pushing the handle and in the unblocked-leveled handle configuration (S), the drive member and the ejection cam are sufficiently close to each other to enable the disengagement of the lever from the blocking means by pushing the handle.

15. The opening control according to claim 11, comprising means for receiving a representative data of a speed of the motor vehicle so that when the representative data is higher than a predetermined value, the opening control is in the blocked-leveled handle configuration.

16. The opening control according to claim 11, wherein the pivot means comprise a clutch cam, movable about a cam axis and connected to the electric actuator, in which the clutch cam has a guide surface shaped so as to cooperate with an internal profile of the lever in order to position the lever in the unblocked-leveled handle configuration (S) starting from the blocked-leveled handle configuration (M0).

17. The opening control according to claim 16, wherein the internal profile of the lever is shaped so that the clutch cam cooperates with this internal profile in order to control the return movement of the lever from the at least one blocking position back into the ejection position.

18. The opening control according to claim 1, wherein the pivot means comprise a retraction cam, movable about a cam axis, in which the retraction cam has a guide surface configured to make the lever pivot from the ejection position to the at least one blocking position via the electrical actuation by the electric actuator.

19. The opening control according to claim 18, wherein the guide surface of the retraction cam is configured to forcibly guide, against an impediment to the automatic return of the lever back into the ejection position, the ejection of the handle by electrical actuation of the retraction cam in a direction opposite to a retraction direction.

20. The opening control according to claim 18, wherein the lever comprises an internal profile and a cam configured to cooperate with the retraction cam.

21. The opening control according to claim 1, wherein the lever comprises two lateral cheeks connected to each other by upper and lower transverse branches intended to bear respectively on upper and lower surfaces of an internal portion of the handle, the two lateral cheeks comprising openings, for the passage of the pivot means.

22. The opening control according to claim 1, comprising mechanical means, allowing unlocking the opening control, when it the opening control is latched and in the absence of electrical energy, by one or several mechanical actuation(s) from an outside of the door leaf on the pivot means or on the blocking means.

23. A door leaf for a motor vehicle, including an opening control according to claim 1.

* * * * *